US006276343B1

(12) United States Patent
Kawamura et al.

(10) Patent No.: US 6,276,343 B1
(45) Date of Patent: Aug. 21, 2001

(54) LEAK DIAGNOSTIC SYSTEM OF EVAPORATIVE EMISSION CONTROL SYSTEM FOR INTERNAL COMBUSTION ENGINES

(75) Inventors: Katsuhiko Kawamura, Kanagawa; Hideaki Kobayashi, Yokohama, both of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/369,192

(22) Filed: Aug. 6, 1999

(30) Foreign Application Priority Data

Aug. 21, 1998 (JP) ..... 10-235334

(51) Int. Cl.[7] ..... F02M 33/02
(52) U.S. Cl. ..... 123/520; 123/516
(58) Field of Search ..... 123/516, 518, 123/519, 520, 198 D, 521

(56) References Cited

U.S. PATENT DOCUMENTS

| | | | | |
|---|---|---|---|---|
| 5,448,980 | * | 9/1995 | Kawamura et al. | 123/520 |
| 5,450,834 | * | 9/1995 | Ymanaka et al. | 123/520 |
| 5,460,143 | * | 10/1995 | Narita | 123/520 |
| 5,542,397 | * | 8/1996 | Takahata et al. | 123/520 |
| 6,016,792 | * | 1/2000 | Kawano et al. | 123/520 |

FOREIGN PATENT DOCUMENTS

| | | |
|---|---|---|
| 7-139439 | 5/1995 | (JP) . |
| 7189825 | 7/1995 | (JP) . |
| 10-274107 | 10/1998 | (JP) . |

* cited by examiner

*Primary Examiner*—Henry C. Yuen
*Assistant Examiner*—Mahmoud Gimie
(74) *Attorney, Agent, or Firm*—Foley & Lardner

(57) ABSTRACT

In a leak diagnostic system of an evaporative emission control system for an internal combustion system, which utilizes a change in internal pressure in a predetermined fluid-flow passage ranging from a fuel tank via a canister to a purge control valve, in addition to a relative-pressure sensor for sensing the internal pressure, an atmospheric-pressure sensor is provided for sensing atmospheric pressure. The leak diagnostic system includes a control module which samples the pressure in the predetermined fluid-flow passage as a first fluid-flow passage pressure at a first sampling time when a predetermined decompressing operation is completed, and samples the pressure in the predetermined fluid-flow passage as a second fluid-flow passage pressure at a second sampling time when a predetermined time interval has been elapsed from the first sampling time. The leak diagnostic system makes a leak diagnosis by comparing the pressure differential between the first and second fluid-flow passage pressures with a predetermined leak criterion. The control module compensates for the pressure differential by the atmospheric-pressure change occurring for a time interval from the first sampling time to the second sampling time.

14 Claims, 11 Drawing Sheets

LEAK DIAGNOSTIC SYSTEM OF EVAPORATIVE EMISSION CONTROL SYSTEM FOR INTERNAL COMBUSTION ENGINES

BACKGROUND OF THE INVENTION

1. Field of the Invention

The present invention relates to a leak diagnostic system of an evaporative emission control system for internal combustion engines, and specifically to a leak diagnostic system that makes a diagnosis on leakage for purge air and fuel vapor.

2. Description of the Prior Art

Each car now has an evaporative emission control system as one of automotive emission control systems. This is a system that captures or traps any fuel vapors coming from a fuel tank mainly when the engine is not running and prevents them from escaping into atmosphere. As is generally known, a typical evaporative emission control system for an internal combustion engine, has a carbon or charcoal canister filled with activated carbon or charcoal for temporarily storing, trapping or adsorbing fuel vapors emitted from a fuel tank when the engine is not running, and a purge control valve disposed in a purge line connecting an induction system with the canister. Generally, the action of clearing or removing the trapped fuel vapor from the canister is called "purging". Usually, when predetermined engine operating conditions are satisfied after the engine is started, the purge control valve is opened and thus engine vacuum is admitted to the canister. Thus, the engine vacuum draws fresh air up through the canister via an air port. The fresh air flowing through the interior of the canister, picks up these trapped fuel vapors, and removes the trapped fuel vapors from the canister, and thereafter the purge gas is burned in the combustion chamber. If there is a hole or a leak in the middle of a fluid-flow passage or a piping ranging from the fuel tank to the induction system or the intake manifold or the intake collector section, or in the presence of the canister purge line hose damaged or disconnected, fuel vapors could escape into the atmosphere. Therefore, diagnosis for fuel-vapor leakage is so important. Such fuel-vapor leak diagnostic devices have been disclosed in Japanese Patent Provisional Publication Nos. 7-139439, 7-189825, and 10-274107. The fundamental concept of fuel-vapor leak diagnosis as described in these Japanese Patent Provisional Publications, is as follows. First of all, both ends of the previously-noted piping are closed by a valve means to establish a closed space. Then, the closed space is shifted to a state (e.g., a decompressed state) that there is a pressure differential (e. g., a pressure drop) relative to atmospheric pressure, for example by way of introduction of vacuum (a negative pressure). Thereafter, the change in internal pressure in the closed space is monitored, and the presence or absence of fuel-vapor leakage is determined depending on the rate of change in internal pressure. Generally, to establish the closed space, a so-called drain cut valve is used for opening and closing the air port of the canister, in addition to a typical purge control valve. To monitor or detect the change in internal pressure in the closed space, a pressure sensor or a pressure gage is located in the piping. For leak diagnosis, the Japanese Patent Provisional Publication No. 7-139439 teaches the comparison of the time rate of pressure-rise in the closed space, obtained with the purge control valve closed and the drain cut valve closed, with a predetermined threshold value. In the diagnostic system as disclosed in the Japanese Patent Provisional Publication Nos. 7-189825 or 10-274107, a leak area is arithmetically calculated or estimated on the basis of four parameters, namely a first parameter being an elapsed time DT3 measured from a time when the decompressing operation is started to a time when a predetermined pressure-drop p2 is reached, a second parameter being a pressure differential DP3 between an initial pressure value $P_0$ of the closed space and an internal pressure P, sampled with the lapse of a predetermined time period t5 during which gas fluid-flow stops and thus there is no pressure loss after completion of the decompressing operation, a third parameter being a pressure differential DP4 between the initial pressure value $P_0$ and an internal pressure P, sampled at a time when a predetermined pressure rise p3 is reached from the sampling time of the pressure differential DP3, and a fourth parameter being a time interval DT4 measured from completion of the decompressing operation to the sampling time of the pressure differential DP4 (see FIG. 4). For leak diagnosis, both of the two Japanese Patent Provisional Publication Nos. 7-189825 and 10-274107 teach the comparison of the calculated leak area with a predetermined threshold value. The previously-noted three Japanese Patent Provisional Publications use a popular pressure sensor (or a popular pressure gage). This is a relative-pressure measuring instrument that senses a pressure value on the basis of atmospheric pressure (serving as a reference pressure level). For instance, such a relative-pressure measuring instrument measures the difference between internal and external pressure on its pressure-sensing element. Since the external pressure is almost always atmospheric pressure, the pressure gage reads the difference between a given pressure and the pressure of the atmosphere. That is, the pressure reading of the instrument is a "gage pressure".

SUMMARY OF THE INVENTION

Owing to the use of a popular relative-pressure measuring instrument, the pressure reading is affected by changes in the external pressure (the atmospheric pressure) acting on the instrument. Thus, there is a possibility that the accuracy of leak diagnosis is lowered in the presence of remarkable changes in the atmospheric pressure such as during downhill driving or during uphill driving. The inventors of the present invention have analyzed as to how the pressure reading of internal pressure in the previously-noted closed space is affected by changes in the atmospheric pressure. That is, the previously-discussed pressure differential DP4 sampled during uphill driving must be fundamentally identical to that sampled during flat-road driving. However, when the uphill driving state is continued, the atmospheric pressure drops. In case of the use of a popular relative-pressure measuring instrument, the pressure differential DP4 is affected by the changes in atmospheric pressure. As seen in FIG. 9, during the uphill driving, the atmospheric pressure gradually drops. Assuming that an atmospheric pressure value, which is measured simultaneously at a sampling time for the first pressure differential DP3, is denoted by Pa1, in case that the vehicle is driving on flat roads, the second pressure differential DP4 is obtained or calculated on the basis of the atmospheric pressure value Pa1. To the contrary, if the vehicle is traveling uphill, atmospheric pressure measured simultaneously at a sampling time for the second pressure differential DP4 becomes dropped to a pressure level Pa2 lower than the above-mentioned atmospheric pressure value Pa1 (measured during the flat-road driving). Due to the use of the relative-pressure measuring instrument, the second pressure differential DP4 is obtained or calculated on the basis of the atmospheric pressure value Pa2 (<Pa1) during the uphill driving. As appreciated from the one-dotted horizontal line (indicating changes in atmospheric pressure during flat-road driving) and the slightly downward sloped solid line (indicating changes in atmospheric pressure during uphill driving) shown in FIG. 9, a value of the second pressure differential DP4 sampled during the uphill driving becomes less than a value of the second pressure differential DP4 sampled during the flat-road driving, owing to the change (pressure-drop) in the pressure of the atmosphere. That is, during the uphill driving, the atmospheric-pressure change ΔPa (=Pa1−Pa2) is included in the second pressure differential DP4 as an error. As a result of this, a leak area (AL2) may be arithmetically calculated apparently as a leak area greater than a predetermined threshold value (c2). There is a possibility that the electronic control module (ECM) or electronic control unit (ECU) misdiagnoses that the calculated leak area (AL2) reaches the predetermined threshold value (c2) even when the actual leak area does not exceed the predetermined threshold value. Conversely, if the leak diagnosis is executed during downhill traveling, a leak area (AL2) may be calculated apparently as a leak area less than the predetermined threshold value (c2), owing to a rise in the atmospheric pressure. There is a possibility that the electronic control module (ECM) misdiagnoses that the calculated leak area (AL2) does not yet reach the predetermined threshold value (c2) even when the actual leak area has exceeded the predetermined threshold value. In lieu of the previously-described leak diagnostic device based on comparison between the result of arithmetic-calculation of the leak area (AL2) and the predetermined threshold value (c2), the following way is used as a leak diagnosis method utilizing a change in internal pressure in the closed space (a change in the pressure in the fluid-flow passage ranging from the fuel tank to the purge control valve). As seen in FIG. 10, a pressure P1 in the fluid-flow passage is first sensed or sampled by a popular relative-pressure measuring instrument with the lapse of a predetermined time period during which gas fluid-flow stops and thus there is no pressure loss after completion of the decompressing operation. Second, a pressure P2 in the fluid-flow passage is sensed or sampled again as soon as a predetermined period of time has elapsed from the sampling time of the pressure P1. Thereafter, a change in internal pressure in the closed space, that is, the pressure differential ΔPe is computed as subtraction (P1−P2) of P2 from P1. Leak diagnosis can be simply executed by comparing the pressure differential ΔPe (=P1−P2) to a predetermined threshold value. In the same manner as sampling of the previously-noted second pressure differential DP4, the change in atmospheric pressure is included in the pressure P2 as an error. In more detail, the pressure P2 sampled during uphill driving must be fundamentally identical to that sampled during flat-road driving. Assuming that an atmospheric pressure value, which is measured at the same time as a sampling time for the pressure P1, is denoted as Pa1, the pressure P2 is obtained or sensed on the basis of the atmospheric pressure value Pa1 if the vehicle is driving on flat roads. To the contrary, if the vehicle is traveling uphill, atmospheric pressure measured at a sampling time for the pressure P2 becomes dropped to a pressure level Pa2 lower than the above-mentioned atmospheric pressure value Pa1. Due to the use of the relative-pressure measuring instrument, the pressure P2 is obtained or sensed on the basis of the atmospheric pressure value Pa2 (<Pa1) during the uphill driving. As appreciated from the one-dotted horizontal line (indicating changes in atmospheric pressure during flat-road driving) and the slightly downward sloped solid line (indicating changes in atmospheric pressure during uphill driving) shown in FIG. 11, a value of the pressure P2 sampled during the uphill driving becomes less than a value of the pressure P2 sampled during the flat-road driving, owing to the change (pressure-drop) in atmospheric pressure. During the uphill driving, the atmospheric-pressure change ΔPa (=Pa1−Pa2) is included in the pressure P2 as an error. As a result, a pressure differential (ΔPe) may be arithmetically calculated apparently as a pressure differential greater than a predetermined threshold value. There is a possibility that the electronic control module (ECM) misdiagnoses that the calculated pressure differential (ΔPe) reaches the predetermined threshold value even when the actual pressure differential does not exceed the predetermined threshold value. Conversely, if the leak diagnosis is executed during downhill traveling, a pressure differential (ΔPe) may be calculated apparently as a pressure differential less than the predetermined threshold value, owing to a rise in the atmospheric pressure. There is a possibility that the electronic control module (ECM) misdiagnoses that the calculated pressure differential (ΔPe) does not yet reach the predetermined threshold value even when the actual pressure differential has exceeded the predetermined threshold value.

Accordingly, it is an object of the invention to provide a leak diagnostic system for an evaporative emission control system for internal combustion engines which avoids the aforementioned disadvantages of the prior art.

It is another object of the invention to provide a leak diagnostic system for an evaporative emission control system for internal combustion engines which is capable of making a precise diagnosis on leakage for purge air and fuel vapor under various vehicle driving conditions containing flat-road driving, and uphill or downhill driving, while using a relative-pressure measuring instrument that senses and monitors a change of internal pressure in a fluid-flow passage, ranging from a fuel tank to a purge control valve, on the basis of atmospheric pressure (serving as a reference pressure level). Briefly speaking, a leak diagnostic system of the invention has an atmospheric pressure sensor that senses an atmospheric pressure value in synchronization with a sampling time for the pressure in the fluid-flow passage, and an atmospheric-pressure-change compensation section that compensates for a pressure-differential indicative parameter (ΔPe or DP4 used for leak diagnosis) by a change in the atmospheric pressure sensed, so as to eliminate an error produced owing to the use of the relative-pressure measuring instrument during the leak diagnosing operation executed when shifting to uphill or downhill driving.

In order to accomplish the aforementioned and other objects of the present invention, a leak diagnostic system of an evaporative emission control system for an internal combustion engine having a canister with an air vent, comprises a first fluid-flow passage introducing fuel vapors emitted from a fuel tank into the canister, a second fluid-flow passage through which the canister is connected to an intake pipe of an induction system, a purge control valve opening and closing the second fluid-flow passage, a drain cut-off valve opening and closing the air vent of the canister, a relative-pressure sensor sensing a pressure in a predetermined fluid-flow passage ranging from the fuel tank via the canister to the purge control valve, relative to atmospheric pressure, an atmospheric-pressure sensor sensing the atmospheric pressure, and a control module configured to be connected to at least the purge control valve, the drain cut-off valve, the relative-pressure sensor, and the atmospheric-pressure sensor, the control module comprising a leak-diagnosis permission condition decision section determining whether a predetermined leak-diagnosis permission condition is met, a decompression section reducing the pressure in the predetermined fluid-flow passage, while adjusting both an opening of the drain cut-off valve and an opening of the purge control valve, only when the predetermined leak-diagnosis permission condition is met, a first sampling section sampling the pressure in the predetermined fluid-flow passage as a first fluid-flow passage pressure at a first sampling time when a predetermined decompressing operation is completed by the decompression section, and sampling the pressure in the predetermined fluid-flow passage as a second fluid-flow passage pressure at a second sampling time when a predetermined time interval has been elapsed from the first sampling time, a first arithmetic-calculation section calculating a pressure differential between the first and second fluid-flow passage pressures, a second sampling section sampling the atmospheric pressure sensed by the atmospheric-pressure sensor as a first atmospheric pressure at the first sampling time and sampling the atmospheric pressure sensed by the atmospheric-pressure sensor as a second atmospheric pressure at the second sampling time, a second arithmetic-calculation section calculating an atmospheric-pressure change between the first and second atmospheric pressures, a compensation section compensating for the pressure differential calculated by the first arithmetic-calculation section by the atmospheric-pressure change calculated by the second arithmetic-calculation section to produce a compensated pressure differential, and a leak-diagnosis section making a leak-diagnosis by comparing the compensated pressure differential with a predetermined threshold value.

According to another aspect of the invention, a leak diagnostic system of an evaporative emission control system for an internal combustion engine having a canister with an air vent, comprises a first fluid-flow passage introducing fuel vapors emitted from a fuel tank into the canister, a second fluid-flow passage through which the canister is connected to an intake pipe of an induction system, a purge control valve opening and closing the second fluid-flow passage, a drain cut-off valve opening and closing the air vent of the canister, a relative-pressure sensor sensing a pressure in a predetermined fluid-flow passage ranging from the fuel tank via the canister to the purge control valve, relative to atmospheric pressure, an atmospheric-pressure sensor sensing the atmospheric pressure, and a control module configured to be connected to at least the purge control valve, the drain cut-off valve, the relative-pressure sensor, and the atmospheric-pressure sensor, the control module comprising a leak-diagnosis permission condition decision section determining whether a predetermined leak-diagnosis permission condition is met, a decompression section reducing the pressure in the predetermined fluid-flow passage, while adjusting both an opening of the drain cut-off valve and an opening of the purge control valve, only when the predetermined leak-diagnosis permission condition is met, a first sampling section sampling the pressure in the predetermined fluid-flow passage as an initial pressure just before a predetermined decompressing operation is started by the decompression section, the pressure in the predetermined fluid-flow passage as a first fluid-flow passage pressure at a first sampling time when the predetermined decompressing operation is completed, and sampling the pressure in the predetermined fluid-flow passage as a second fluid-flow passage pressure at a second sampling time when a predetermined time interval has been elapsed from the first sampling time, a first arithmetic-calculation section calculating a first pressure differential between the initial pressure and the first fluid-flow passage pressure, and calculating a second pressure differential between the initial pressure and the second fluid-flow passage pressure, a second sampling section sampling the atmospheric pressure sensed by the atmospheric-pressure sensor as a first atmospheric pressure at the first sampling time and sampling the atmospheric pressure sensed by the atmospheric-pressure sensor as a second atmospheric pressure at the second sampling time, a second arithmetic-calculation section calculating an atmospheric-pressure change between the first and second atmospheric pressures, a compensation section compensating for the second pressure differential calculated by the first arithmetic-calculation section by the atmospheric-pressure change calculated by the second arithmetic-calculation section to produce a compensated pressure differential, a third arithmetic-calculation section calculating a leak area on the basis of the first pressure differential and the compensated pressure differential, and a leak-diagnosis section making a leak-diagnosis by comparing the leak area calculated by the third arithmetic-calculation section with a predetermined leak criterion.

According to a further aspect of the invention, in an internal combustion engine equipped with an evaporative emission control system having at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, a leak diagnostic system of the evaporative emission control system, comprises a relative-pressure sensing means for sensing a pressure in a predetermined fluid-flow passage ranging from the fuel tank via the canister to the purge control valve, relative to atmospheric pressure, an atmospheric-pressure sensing means for sensing the atmospheric pressure, and control means configured to be connected to at least the purge control valve, the drain cut-off valve, the relative-pressure sensing means, and the atmospheric-pressure sensing means, the control means comprising a leak-diagnosis permission condition decision means for determining whether a predetermined leak-diagnosis permission condition is met, a decompression means for reducing the pressure in the predetermined fluid-flow passage, while adjusting both an opening of the drain cut-off valve and an opening of the purge control valve, only when the predetermined leak-diagnosis permission condition is met, a first sampling means for sampling the pressure in the predetermined fluid-flow passage as a first fluid-flow passage pressure at a first sampling time when a predetermined decompressing operation is completed by the decompression means, and sampling the pressure in the predetermined fluid-flow passage as a second fluid-flow passage pressure at a second sampling time when a predetermined time interval has been elapsed from the first sampling time, a first arithmetic-calculation means for calculating a pressure differential between the first and second fluid-flow passage pressures, a second sampling means for sampling the atmospheric pressure sensed by the atmospheric-pressure sensing means as a first atmospheric pressure at the first sampling time and sampling the atmospheric pressure sensed by the atmospheric-pressure sensing means as a second atmospheric pressure at the second sampling time, a second arithmetic-calculation means for calculating an atmospheric-pressure change between the first and second atmospheric pressures, a compensation means for compensating for the pressure differential calculated by the first arithmetic-calculation means by the atmospheric-pressure change calculated by the second arithmetic-calculation means to produce a compensated pressure differential, and a leak-diagnosis means for making a leak-diagnosis by comparing the compensated pressure differential with a predetermined threshold value.

According to a still further aspect of the invention, in an internal combustion engine equipped with an evaporative emission control system having at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, a leak diagnostic system of the evaporative emission control system, comprises a relative-pressure sensing means for sensing a pressure in a predetermined fluid-flow passage ranging from the fuel tank via the canister to the purge control valve, relative to atmospheric pressure, an atmospheric-pressure sensing means for sensing the atmospheric pressure, and control means configured to be connected to at least the purge control valve, the drain cut-off valve, the relative-pressure sensing means, and the atmospheric-pressure sensing means, the control means comprising a leak-diagnosis permission condition decision means for determining whether a predetermined leak-diagnosis permission condition is met, a decompression means for reducing the pressure in the predetermined fluid-flow passage, while adjusting both an opening of the drain cut-off valve and an opening of the purge control valve, only when the predetermined leak-diagnosis permission condition is met, a first sampling means for sampling the pressure in the predetermined fluid-flow passage as an initial pressure just before a predetermined decompressing operation is started by the decompression means, the pressure in the predetermined fluid-flow passage as a first fluid-flow passage pressure at a first sampling time when the predetermined decompressing operation is completed, and sampling the pressure in the predetermined fluid-flow passage as a second fluid-flow passage pressure at a second sampling time when a predetermined time interval has been elapsed from the first sampling time, a first arithmetic-calculation means for calculating a first pressure differential between the initial pressure and the first fluid-flow passage pressure, and calculating a second pressure differential between the initial pressure and the second fluid-flow passage pressure, a second sampling means for sampling the atmospheric pressure sensed by the atmospheric-pressure sensing means as a first atmospheric pressure at the first sampling time and sampling the atmospheric pressure sensed by the atmospheric-pressure sensing means as a second atmospheric pressure at the second sampling time, a second arithmetic-calculation means for calculating an atmospheric-pressure change between the first and second atmospheric pressures, a compensation means for compensating for the second pressure differential calculated by the first arithmetic-calculation means by the atmospheric-pressure change calculated by the second arithmetic-calculation means to produce a compensated pressure differential, a third arithmetic-calculation means for calculating a leak area on the basis of the first pressure differential and the compensated pressure differential, and a leak-diagnosis means for making a leak-diagnosis by comparing the leak area calculated by the third arithmetic-calculation means with a predetermined leak criterion.

According to another aspect of the invention, a method for making a leak diagnosis on an evaporative emission control system for an internal combustion engine, wherein the evaporative emission control system includes at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, the method comprises sensing a pressure in a predetermined fluid-flow passage ranging from the fuel tank via the canister to the purge control valve, relative to atmospheric pressure, sensing the atmospheric pressure, determining whether a predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, sampling the pressure in the predetermined fluid-flow passage as a first fluid-flow passage pressure at a first sampling time when the pressure in the predetermined fluid-flow passage is reduced to a predetermined value, sampling the pressure in the predetermined fluid-flow passage as a second fluid-flow passage pressure at a second sampling time when a predetermined time interval has been elapsed from the first sampling time, calculating a pressure differential between the first and second fluid-flow passage pressures, sampling the atmospheric pressure as a first atmospheric pressure at the first sampling time, sampling the atmospheric pressure as a second atmospheric pressure at the second sampling time, calculating an atmospheric-pressure change between the first and second atmospheric pressures, compensating for the pressure differential between the first and second fluid-flow passage pressures by the atmospheric-pressure change to produce a compensated pressure differential, and making a leak-diagnosis by comparing the compensated pressure differential with a predetermined threshold value.

According to another aspect of the invention, a method for making a leak diagnosis on an evaporative emission control system for an internal combustion engine, wherein the evaporative emission control system includes at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, the method comprises sensing a pressure in a predetermined fluid-flow passage ranging from the fuel tank via the canister to the purge control valve, relative to atmospheric pressure, sensing the atmospheric pressure, determining whether a predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, sampling the pressure in the predetermined fluid-flow passage as an initial pressure just before starting to reduce the pressure in the predetermined fluid-flow passage, sampling the pressure in the predetermined fluid-flow passage as a first fluid-flow passage pressure at a first sampling time when the pressure in the predetermined fluid-flow passage is reduced to a predetermined value, sampling the pressure in the predetermined fluid-flow passage as a second fluid-flow passage pressure at a second sampling time when a predetermined time interval has been elapsed from the first sampling time, calculating a first pressure differential between the initial pressure and the first fluid-flow passage pressure, calculating a second pressure differential between the initial pressure and the second fluid-flow passage pressure, sampling the atmospheric pressure as a first atmospheric pressure at the first sampling time, sampling the atmospheric pressure as a second atmospheric pressure at the second sampling time, calculating an atmospheric-pressure change between the first and second atmospheric pressures, compensating for the second pressure differential by the atmospheric-pressure change to produce a compensated pressure differential, calculating a leak area on the basis of the first pressure differential and the compensated pressure differential, and making a leak-diagnosis by comparing the leak area with a predetermined leak criterion.

DESCRIPTION OF THE PREFERRED EMBODIMENTS

Figure 1:
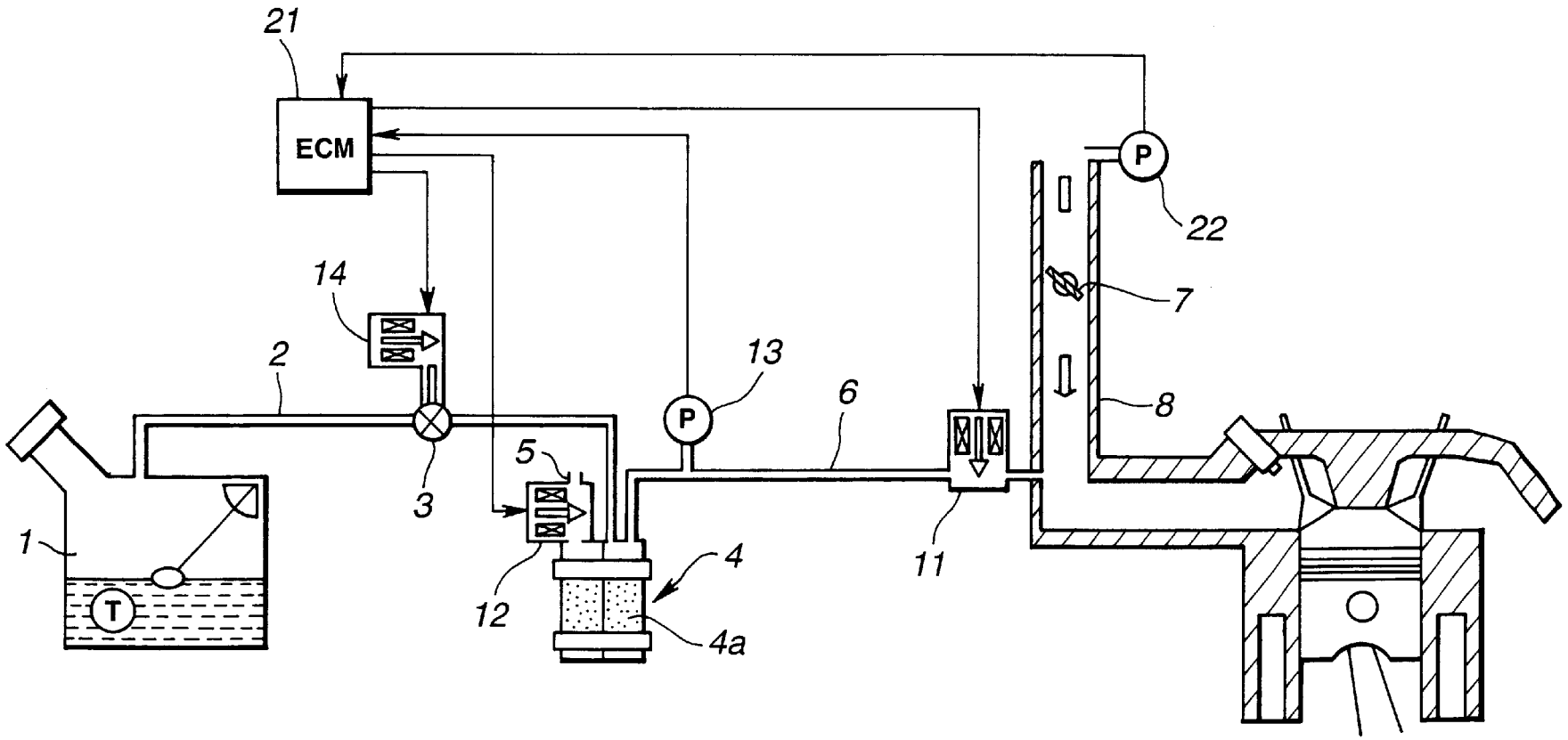
FIG. 1 is a system diagram illustrating a leak diagnosis system for an evaporative emission control system, made according to the invention.
Figure 2:
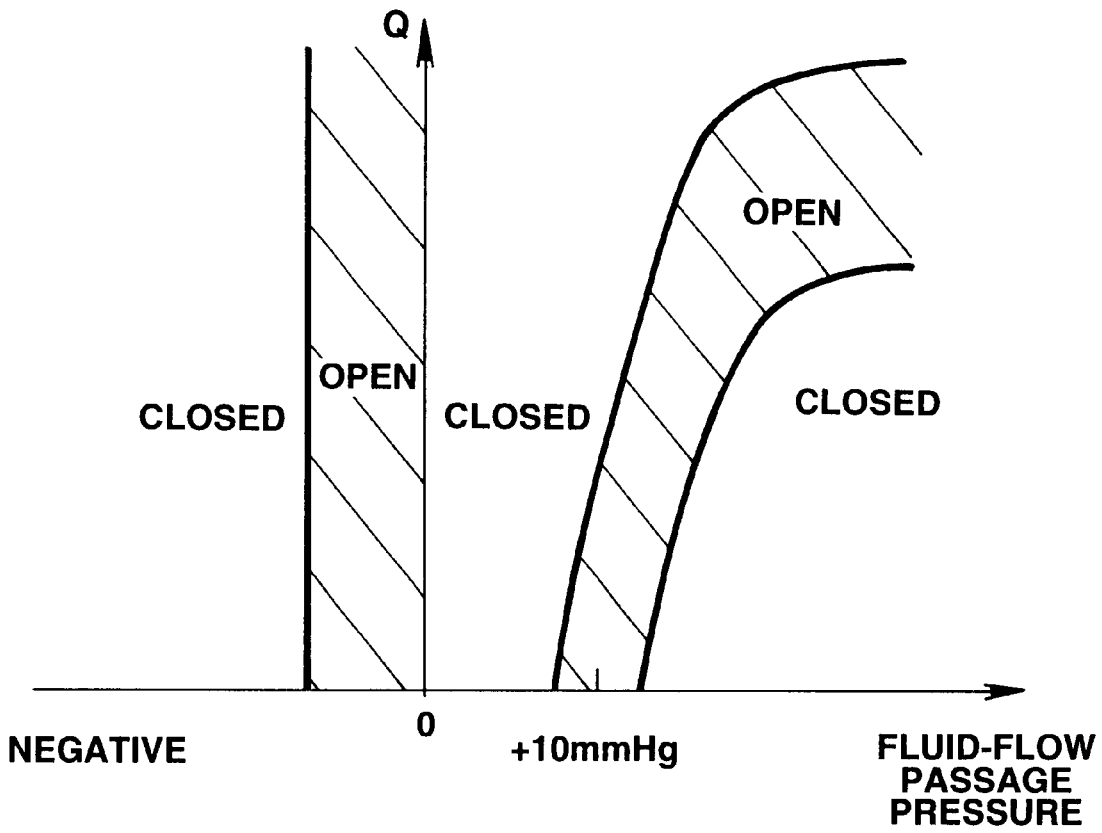
FIG. 2 is a characteristic diagram illustrating a flow-rate (Q) characteristic of a vacuum cut valve 3.
Figure 3:
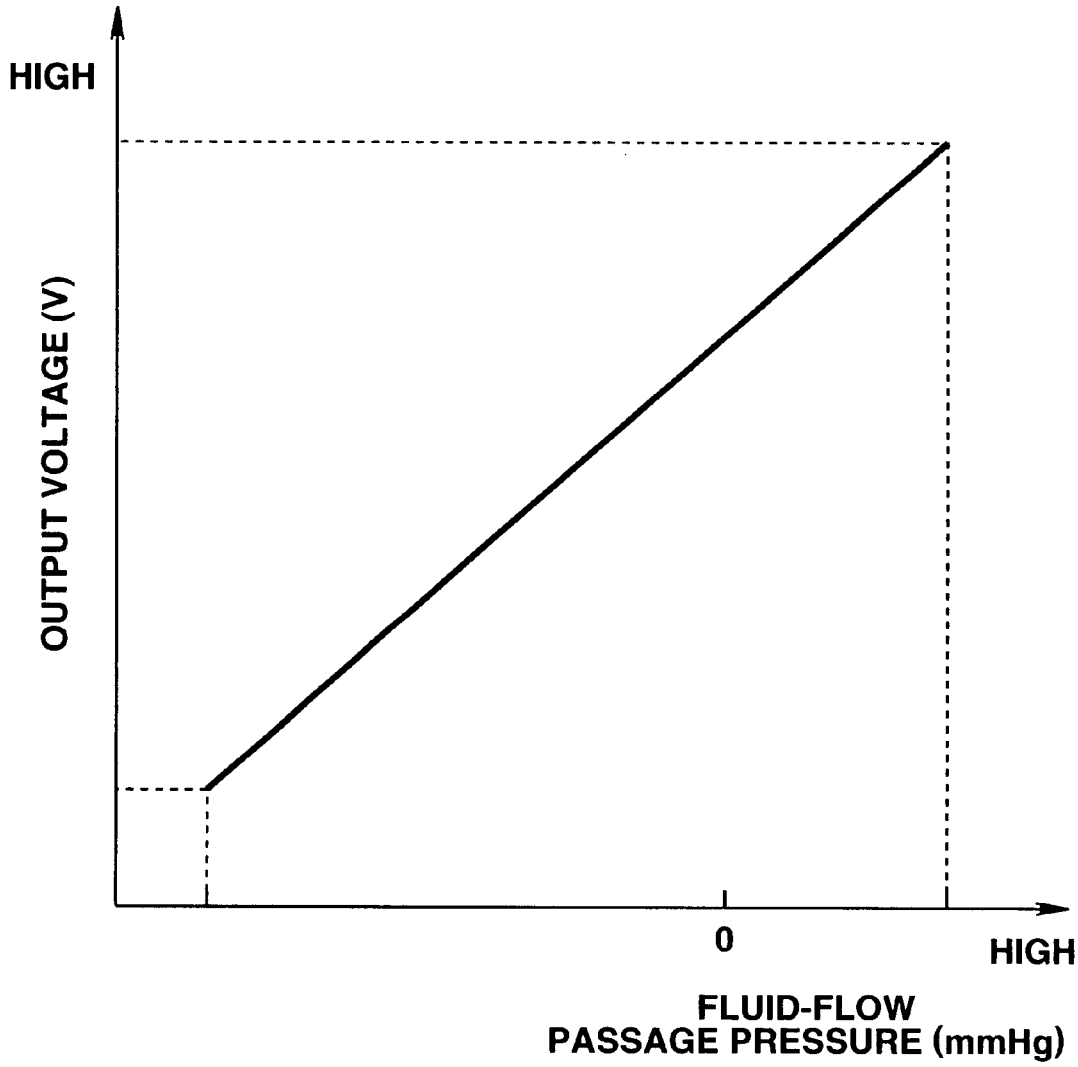
FIG. 3 is a pressure sensor characteristic of a relative-pressure sensor whose output (an output voltage) is proportionate to its input pressure (a fluid-flow passage pressure).

Referring now to the drawings, particularly to FIG. 1, a leak diagnostic system of the invention is exemplified in an evaporative emission control system for an internal combustion engine. In order to temporarily capture, trap or adsorb evaporative emission (fuel vapors) escaped from a fuel tank 1, a carbon or charcoal canister 4 filled with adsorbent such as activated carbon or charcoal particles contained in the canister body. A fuel-tank vapor vent line 2 (a first fluid-flow passage) is connected via a vacuum cut-off valve (simply a vacuum cut valve) 3 to an inlet port of the canister 4. Fuel vapors emitted from the fuel tank 1 are transferred through the fuel-tank vent line 2 via the vacuum cut valve 3 to the canister 4, and then trapped or adsorbed by the activated carbon or charcoal particles contained in the canister body. "Adsorb" means that the fuel vapors are trapped by sticking to the outside of the activated carbon or charcoal particles 4*a*. The activated carbon or charcoal canister 4 has an air vent tube 5 usually formed at the closed bottom of the canister, for introducing fresh air therethrough into the canister and for discharging air separated from the fuel vapors by the trapping action of the canister to the atmosphere. A drain cut-off valve (simply a drain cut valve) 12, which will be fully described later, is provided in the air vent tube 5 for shutting off the entry of fresh air into the interior of the canister body and permitting air discharge (except the trapped fuel vapor) from the canister by closing and opening the air vent 5. For the purpose of illustrative simplicity, in FIG. 1, the air-vent-tube and drain-cut-valve unit is illustrated on the canister 4. The vacuum cut valve 3 is mechanically operated depending on the internal pressure in the fuel tank 1 (or the pressure in the fuel-tank vent line 2). As seen in the flow-rate characteristic diagram shown in FIG. 2, the valve 3 is opened when the internal pressure in the fuel tank 1 drops below the atmospheric pressure (a reference pressure of 0 mmHg). The valve 3 is also opened when the internal pressure in the fuel tank exceeds a predetermined pressure level (+10 mmHg) owing to the increase in vapor pressure of fuel vapor created in the fuel tank. As may be appreciated from the characteristic diagram of FIG. 2, hereinafter, a positive sign "+" means a pressure level higher than the atmospheric pressure, whereas a negative sign "−" means a pressure level less than the atmospheric pressure. The canister 4 is also formed with a purge line 6 (a second fluid-flow passage) through which the canister 4 is connected to the collector section 8 of the intake manifold (or the intake pipe) downstream of a throttle valve 7. An electronically-controlled, normally-closed canister purge control valve 11 is disposed in the purge line 6. In the shown embodiment, the purge control valve 11 is driven by way of a stepper motor (herebelow referred to as a "canister-purge stepper motor"), so that the opening of the purge control valve 11 is controlled in response to a control signal or a command from an electronic control unit (ECU) or an electronic control module (ECM) 21, which will be fully described herebelow. The purge control valve 11 is opened in response to the control signal from the ECM 21 when predetermined conditions (canister-purging permission conditions) are met, for example when the engine has reached normal operating temperature after the engine warm-up and is running in the low engine-load range. On the other hand, when the engine is off or if the previously-noted predetermined canister-purging permission conditions are unsatisfied, the canister-purge stepper motor is de-energized to close the purge control valve 11. As a result, the canister-purge stepper motor blocks any engine vacuum to the canister purge control valve 11. When the engine is started and then the predetermined canister-purging permission conditions are met, the purge control valve 11 is opened and thus engine vacuum (intake-manifold vacuum developing downstream of the throttle valve 7) is admitted to the canister 4. The engine vacuum draws fresh air up through the canister 4 via the air vent tube 5. The fresh air flowing through the interior of the canister body, picks up the trapped fuel vapors, and removes or purges the trapped fuel vapors from the activated carbon or charcoal particles 4*a*. The purge gas (containing the removed fuel vapors, i.e., hydrocarbon (HC) vapors) is recirculated or sucked into the collector of the intake manifold 8 through the purge line 6. Thereafter, the purge gas is burned in the combustion chamber (not numbered). As described later, during the leak diagnosis mode at which vacuum pressure (negative pressure) is utilized, the purge control valve 11 functions as a variable orifice which controls a time rate of drop in the internal pressure in a predetermined pressure-change monitoring fluid-flow passage section (a predetermined closed space). The previously-noted drain cut valve 12 is an electronically-controlled, normally-open valve that is closed in response to a control signal from the ECM 21 to shut off the entry of fresh air from atmosphere. Actually, the normally-open drain cut valve 12 is timed to close when the purge control valve 11 is temporarily closed to establish the predetermined pressure-change monitoring fluid-flow passage section (the predetermined closed space ranging from the fuel tank 1 to the purge control valve 11) in the early stages of the leak diagnosing operation. A pressure sensor 13 is located in the purge line between the canister 4 and the purge control valve 11. The pressure sensor 13 is a popular pressure gage such as a relative-pressure measuring instrument that senses or measures the pressure exerted by the fluid in the predetermined closed space relative to atmospheric pressure. Thus, the pressure reading of the pressure sensor 13 is a "gage pressure". As shown in FIG. 3, the output voltage generated from the pressure sensor 13 varies in proportion to variations in the pressure in the predetermined pressure-change monitoring fluid-flow passage section. The pressure in the predetermined pressure-change monitoring fluid-flow passage section will be hereinafter referred to as a "fluid-flow passage pressure", and the sensor 13 will be hereinafter referred to as a "relative-pressure sensor". As seen in FIG. 1, the predetermined pressure-change monitoring fluid-flow passage section widely ranges from the fuel tank 1 to the purge control valve 11. In the shown embodiment, although the relative-pressure sensor 13 is located in the purge line 6 between the canister 4 and the purge control valve 11, the relative-pressure sensor 13 may be located in the predetermined pressure-change monitoring fluid-flow passage section except the purge line 6, for example in the fuel-tank vapor vent line 2. A normally-closed bypass valve 14 is also provided in parallel with the vacuum cut valve 3. The bypass valve 14 is opened to communicate the fuel tank 1 with the canister 4 via the fuel-tank vapor vent line 2, and to introduce the vacuum pressure (the negative pressure) from the inlet port of the canister 4 toward the fuel tank 1, during the early stages of the leak diagnosing operation. Note that, in the leak diagnostic system of the invention, an atmospheric-pressure sensor 22 is also mounted on the induction system of the engine for detecting or measuring a value of the ambient atmospheric pressure Pa around the engine. The atmospheric-pressure sensor 22 is an absolute pressure sensor that senses or measures the pressure exerted by the atmosphere around the engine or near the induction system of the engine, relative to a perfect vacuum.

As appreciated from the system diagram shown in FIG. 1, the electronic control module ECM 21 is generally comprised of a microcomputer that is typical of that now in use many passenger cars and trucks. The microcomputer contains a memory (ROM, RAM), and input/output interface (or input interface circuitry and output interface circuitry), and a central processing unit (CPU). The memory is generally designed to store informational data from the input and output interfaces, and the results of ongoing arithmetic calculations. The input/output interface is the device that allows data to be transferred between input and output devices, CPU and the memory. Output signals from the output interface are amplified to operate electrical loads, namely the valves 11, 12, and 14. Arithmetic and logic sections of the CPU perform necessary arithmetic calculations (a leak diagnosis routine) shown in FIGS. 6 and 7 or shown in FIGS. 2 and 9. Concretely, the input interface of the ECM 21 receives at least a gage pressure indicative signal from the relative-pressure sensor 13 and an atmospheric pressure indicative signal from the atmospheric-pressure sensor 22. In order to perform a diagnosis on the presence or absence of a leak in the evaporative emission control system (exactly, in the predetermined pressure-change monitoring fluid-flow passage section extending from the fuel tank 1 via the canister to the purge control valve 11 or in the predetermined closed space) during operation of the engine, the output interface of the electronic control module (ECM) 21 is electronically connected to the normally-closed canister purge control valve 11, the normally-open drain cut valve 12, and the normally-closed bypass valve 14. Details of the opening and closing control for each of the valves 11, 12, and 14 are explained later. It is desired that the leak diagnosis is performed for every time interval from engine starting and running to engine off. In a similar manner as described in the Japanese Patent Provisional Publication Nos. 7-189825 and 10-274107, the diagnostic system of the embodiment utilizes the vacuum pressure (the negative pressure) for the leak diagnosis. The leak diagnosis procedures (i) through (vii) performed by the system of the embodiment is hereunder described in detail by reference to the timing chart shown in FIG. 4 (indicating the fluid-flow passage pressure-change indicative waveform obtained in the absence of leak) and the timing chart shown in FIG. 5 (indicating the fluid-flow passage pressure-change indicative waveform obtained in the presence of leak).

(i) First of all, the pressure (the negative pressure or the vacuum pressure) of air induced into the induction system (or the intake manifold) is compared to a predetermined sufficiently-low negative pressure threshold such as a very low negative pressure level less than −300 mmHg. For example, when the pressure of air induced into the induction system is below the predetermined pressure threshold (−300 mmHg) and/or the driver's selected gear position is a fourth gear position or a fifth gear position in automotive vehicles with manual transmissions, the ECM 21 determines that adequate vacuum (adequate negative pressure) develops in the induction system and thus a predetermined negative-pressure diagnosis condition is met. In such a case, as seen from an earliest stage (denoted by STAGE 1) of FIG. 4, even during canister purging, the purge control valve 11 is temporarily shifted to its closed state (a de-activated state) in response to a control signal from the ECM to stop the canister purging. At the same time, the normally-closed bypass valve 14 is opened in response to a control signal from the ECM to communicate the fuel tank side with the canister side. Simultaneously, the normally-open drain cut valve 12 is shifted to its closed state (an activated state). As a consequence, the fluid-flow passage ranging from the fuel tank 1 to the purge control valve 11 becomes a closed space. In other words, the predetermined pressure-change monitoring fluid-flow passage section (or the predetermined closed space) is established. At this time, a value P of the pressure in the predetermined pressure-change monitoring fluid-flow passage section, (simply, the fluid-flow passage pressure P) is stored in the memory as an initial pressure $P_0$.

(ii) Second, as seen from the second earliest stage (see STAGE 2 of FIG. 4), the purge control valve 11 is opened again and the engine vacuum is admitted to the predetermined pressure-change monitoring fluid-flow passage section, with the result that the pressure in the predetermined pressure-change monitoring fluid-flow passage section falls. During the second earliest stage (STAGE 2) of the leak diagnosis mode, the purge control valve 11 is set at a predetermined small opening (corresponding to several liters per min in flow rate) less than the maximum opening set during full purging. In this manner, the decompressing operation for the predetermined pressure-change monitoring fluid-flow passage section begins.

(iii) Third, the pressure differential ($P_0$−P) is arithmetically calculated on the basis of the initial pressure $P_0$ and the fluid-flow passage pressure P sampled and sensed by the relative-pressure sensor 13. As seen from the end of the second earliest stage (STAGE 2), as soon as the pressure differential ($P_0$−P) reaches a predetermined value p2 such as several 10 mmHg, a timer incorporated in the ECM 21 measures or samples an elapsed time DT3 (e.g., several seconds or several 10 seconds) from a time when the engine vacuum pressure entry or the decompressing operation is started to a time when the pressure differential ($P_0$−P) reaches the predetermined value p2. At the same time, the purge control valve 11 is closed again. At the end of the second earliest stage (STAGE 2) illustrated in FIG. 4, in the shown embodiment, the pressure differential ($P_0$−P) intendedly reaches the predetermined value p2 with a smooth pressure fall in the predetermined pressure-change monitoring fluid-flow passage section. Assuming that a predetermined time period t4 (e.g., several minutes) has elapsed from the start of the decompressing operation (see the end of the earliest stage (STAGE 1) of FIG. 4) without reaching the predetermined value p2, the predetermined time period t4 is set at or sampled as the elapsed time DT3. The elapsed time DT3 will be hereinafter referred to as a "first-sampled time interval DT3". Necessarily, during the decompressing operation, the adequate negative-pressure state (the adequate engine vacuum pressure entry into the predetermined closed space) must be maintained.

(iv) Fourthly, as a first pressure differential DP3, the pressure differential ($P_0$−P) between the initial pressure $P_0$ and the fluid-pressure passage pressure P is sampled with the lapse of a predetermined time period (or a predetermined delay time) t5 during which gas fluid-flow in the predetermined pressure-change monitoring fluid-flow passage section stops and thus there is no pressure loss after shifting the purge control valve 11 to the closed position (that is, after completion of the decompressing operation). The first pressure differential DP3 (unit: mmHg) corresponds to an actual pressure fall in the predetermined closed space.

Figure 4:
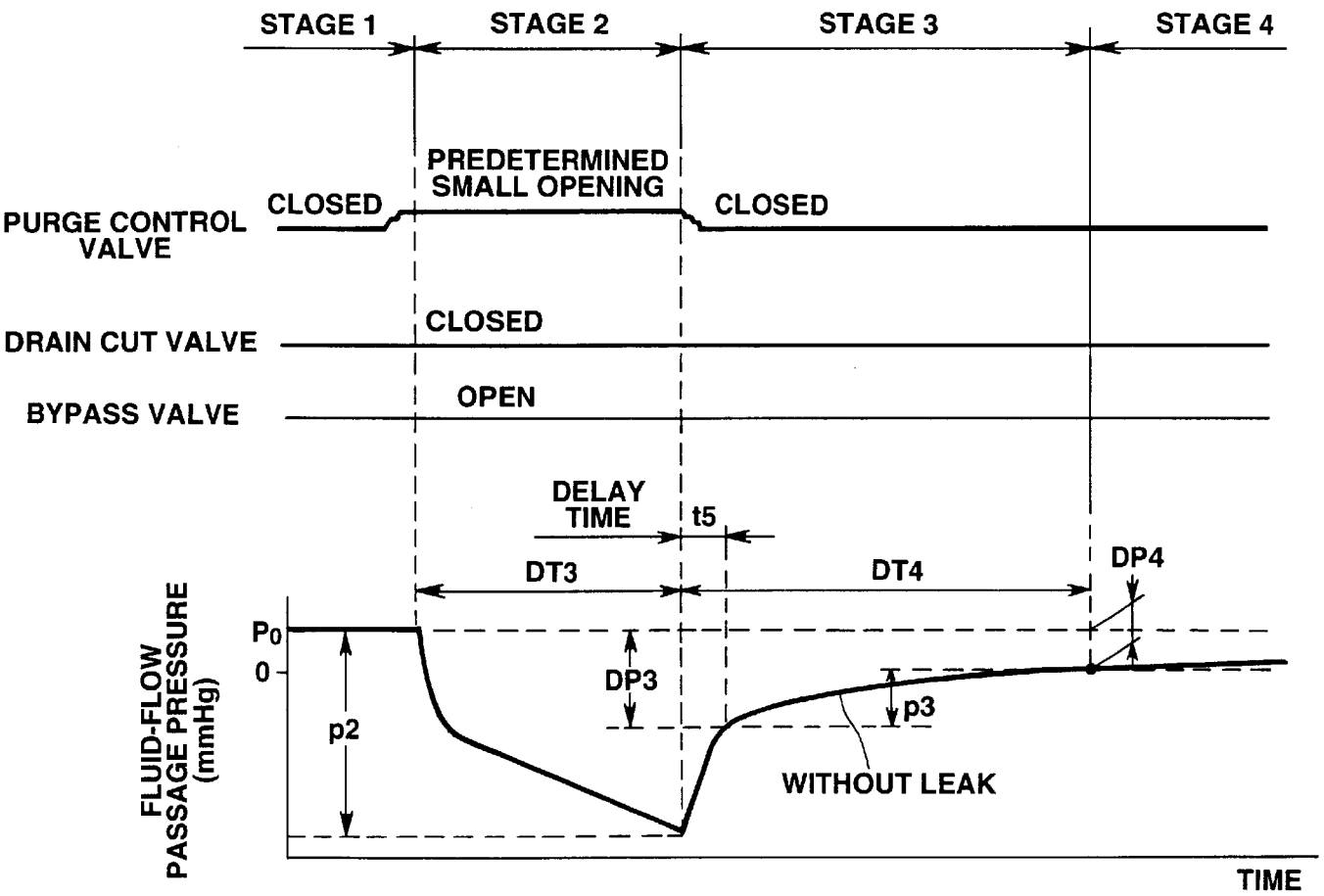
FIG. 4 shows a fluid-flow passage pressure-change indicative waveform obtained in the absence of leak in the evaporative emission control system during the leak diagnosing mode at which a negative pressure (vacuum) is introduced into a predetermined pressure-change monitoring fluid-flow passage section (a predetermined closed space) to monitor a rate of change (pressure-rise) in the internal pressure therein.

(v) Fifthly, in the last two stages (STAGE 3 and STAGE 4) shown in FIG. 4, as a second pressure differential DP4, the pressure differential ($P_0$−P) between the initial pressure $P_0$ and the fluid-flow passage pressure P is sampled at a time when a predetermined pressure rise p3 (e.g., several mmHg) is reached from the sampling time of the first pressure differential DP3. Also, during the time period from the beginning of the third stage (STAGE 3) to the end of the third stage, a time interval DT4 (unit: sec) from completion of the decompressing operation to the sampling time of the second pressure differential DP4 is measured or sampled by way of a timer incorporated in the ECM. In the shown embodiment, the predetermined pressure rise p3 (e.g., several mmHg) is intendedly reached from the sampling time of the first pressure differential DP3 within a predetermined time period t4 that is measured from the end of the second earliest stage (STAGE 2) at which the purge control valve 11 is closed again. Assuming that the predetermined time period t4 (e.g., several minutes) has elapsed from the end of the second earliest stage (STAGE 2) without the predetermined pressure rise p3, the pressure differential ($P_0$−P), which is arithmetically calculated or obtained at the time when the predetermined time period t4 has been elapsed from the end of the second earliest stage (STAGE 2), is set at or sampled as the second pressure differential DP4. In this case, the predetermined time period t4 is set at or sampled as the time interval DT4. The time interval DT4 will be hereinafter referred to as a "second-sampled time interval".

(vi) A leak area AL2 (unit: $mm^2$) in the evaporative emission control system (exactly, in the predetermined pressure-change monitoring fluid-flow passage section) is arithmetically calculated on the basis of the four parameters sampled, namely the first-sampled time interval DT3, the second-sampled time interval DT4, the first pressure differential DP3, and the second pressure differential DP4, from the following expressions (1) and (2).

$$AL2=K\times A' \quad (1)$$

$$A'=C\times(DT3/DT4)\times Ac\times\{(DP3)^{1/2}-(DP4)^{1/2}\}/DP3 \quad (2)$$

where Ac (unit: $mm^2$) denotes an orifice opening (or an orifice size) of the purge control valve 11 whose opening is reduced to the predetermined small opening during the decompressing operation (during the second earliest stage (STAGE 2) of the leak diagnosis mode), C denotes a correction factor, such as 26.6957, needed for matching among units, and K (=f(A')) denotes a correction factor defined as a function f(A') of the variable A' obtained by the expression (2). The leak area AL2 represented by the first expression (1) is obtained by analyzing gas dynamics related to the motion of gases.

(vii) Thereafter, according to the seventh procedure, the processor of the ECM 21 compares the leak area AL2 calculated by the expressions (1) and (2) with a predetermined threshold value (a leak criterion) c2, and decides whether or not a warning lamp comes on, based on the result of comparison between the calculated leak area AL2 and the leak criterion c2. The leak criterion c2 is preset as follows. That is, in case of the predetermined pressure-change monitoring fluid-flow passage section having a predetermined leak, such as an orifice of an orifice size 1 mmϕ (in inside diameter), a value of the leak area AL2 is predetermined from the expressions (1) and (2), on the basis of the four parameters DT3, DT4, DP3 and DP4 sampled through the leak diagnosis procedures (i)–(vi). The leak criterion c2 is preset at an intermediate value between the value of the leak area AL2 obtained in the presence of the predetermined leak (for example, an orifice of an orifice size 1 mmϕ) and a value of the leak area AL2 obtained when there is no leak in the evaporative emission control system (or in the predetermined pressure-change monitoring fluid-flow passage section). In the seventh procedure, if the processor of the ECM decides that the calculated leak area AL2 exceeds the leak criterion c2, a leak diagnostic code is set at a value or a code number indicative of the presence of leakage, and thus the leak indicating code is stored in the memory. Even after the engine is stopped, the leak indicating code is continually memorized.

Figure 8:
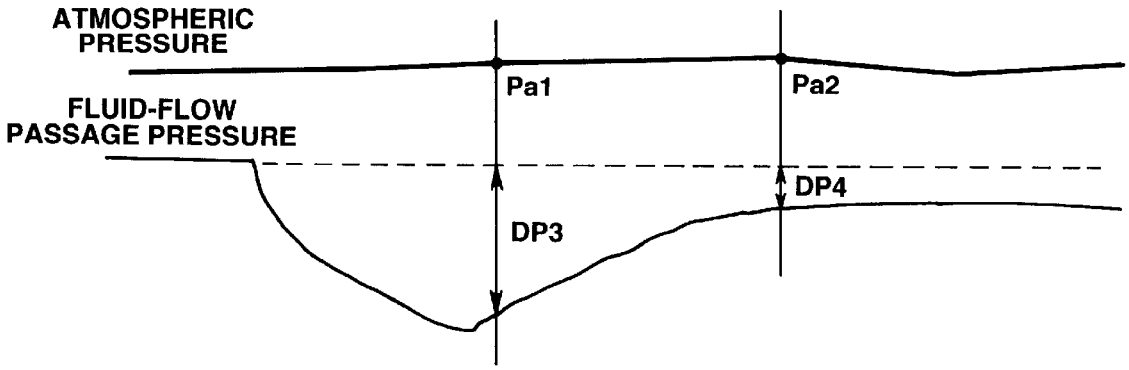
FIG. 8 is a waveform illustrating changes in atmospheric pressure during a leak diagnosing mode at which a leak area (AL2) is arithmetically calculated on the basis of the first (DP3) and second (DP4) pressure differentials sampled and the elapsed time (DT3) and the time interval (DT4), and the presence or absence of leak is determined by comparing the calculated leak area (AL2) with a predetermined threshold value (c2).

As previously discussed, generally, a gage pressure sensor (a relative-pressure sensor) is used as the pressure sensor 13, which senses or measures the pressure in the predetermined pressure-change monitoring fluid-flow passage section. As shown in FIG. 8, in case that there are changes in altitude (i.e., changes in atmospheric pressure) during the leak diagnosis mode, a change (ΔP=Pa1−Pa2) in atmospheric pressure is included in the second pressure differential DP4 (=$P_0$−P) as an error, as previously described by reference to FIG. 9. If the leak diagnosis is performed on the basis of the second pressure differential DP4 (containing the error) without considering any change in atmospheric pressure, the system may misdiagnose. Note that, in the system of the embodiment, the arithmetic calculation for the leak area (AL2), and the comparison (the leak diagnosis) between the calculated leak area AL2 and the predetermined leak criterion c2 are made, in due consideration of the changes in atmospheric pressure. That is to say, the atmospheric pressure is also sampled in synchronization with the sampling time for the first pressure differential DP3 and with the sampling time for the second pressure differential DP4. In the system of the embodiment, the ECM 21 compensates for the second pressure differential DP4 which is affected by the change in atmospheric pressure. Actually, in the system of the embodiment, the atmospheric pressure (Pa) is sampled as a first atmospheric pressure value Pa1 at the sampling time for the first pressure differential DP3, and thereafter the atmospheric pressure (Pa) is sampled as a second atmospheric pressure value Pa2 at the sampling time for the second pressure differential DP4. The compensation for the second pressure differential DP4 is performed by adding the atmospheric-pressure change (Pa1−Pa2) between the first and second atmospheric pressure values Pa1 and Pa2 to the second pressure differential DP4. Therefore, in the system of the embodiment, the leak area AL2 is actually calculated by the following expressions (3) and (4) instead of the previously-explained expressions (1) and (2).

$$AL2=K\times A' \quad (3)$$

$$A'=C\times(DT3/DT4)\times Ac\times\{(DP3)^{1/2}-(DP4+Pa1-Pa2)^{1/2}\}/DP3 \quad (4)$$

where Ac (unit: $mm^2$) denotes an orifice opening (or an orifice size) of the purge control valve 11 whose opening is reduced to the predetermined small opening during the decompressing operation (during the second earliest stage (STAGE 2) of the leak diagnosis mode), C denotes a correction factor, such as 26.6957, needed for matching among units, and K (=f(A')) denotes a correction factor defined as a function f(A') of the variable A' obtained by the expression (3). The following expression (5) is obtained by substituting the expression (4) into the expression (3).

$$AL2=K\times C\times(DT3/DT4)\times Ac\times\{(DP3)^{1/2}-(DP4+Pa1-Pa2)^{1/2}\}/DP3 \quad (5)$$

Figure 9:
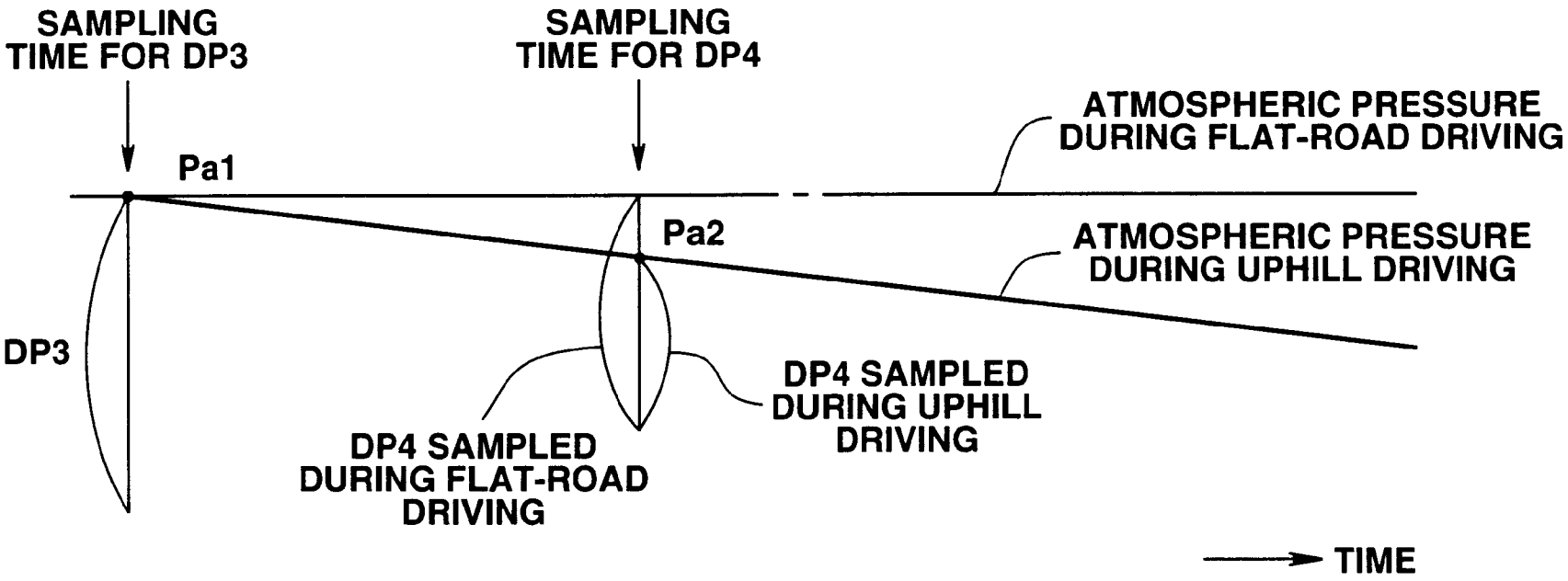
FIG. 9 is an explanatory drawing for an error included in the second pressure differential (DP4) owing to the change in atmospheric pressure.

As previously discussed in reference to FIG. 9, the second pressure differential DP4 sampled during uphill driving must be fundamentally identical to that sampled during flat-road driving. Owing to the use of the popular relative-pressure sensor 13, the pressure differential DP4 is affected by the change in atmospheric pressure, and as a result a value of the second pressure differential DP4 sampled during the uphill driving (with changes in atmospheric pressure or altitude) tends to be less than a value of the second pressure differential DP4 sampled during the flat-road driving (without any change in atmospheric pressure or altitude). In the presence of the fall in atmospheric pressure during the leak diagnosis mode, hitherto, the second pressure differential DP4 contains the error corresponding to the atmospheric-pressure change ΔP (=Pa1−Pa2). In the presence of the fall in atmospheric pressure (Pa) during the leak diagnosis mode, in the conventional system, the leak area AL2 may be arithmetically calculated apparently as a leak area greater than the predetermined leak criterion c2. On the other hand, in the arithmetic calculation for the leak area AL2, executed by the system of the embodiment, during the uphill driving, a positive correction value (Pa1−Pa2) corresponding to the fall in atmospheric pressure (Pa) is added to the second pressure differential DP4 which may become smaller by the fall in atmospheric pressure. Conversely, if the leak diagnosis is executed during downhill driving, the leak area AL2 may be calculated apparently as a leak area less than the predetermined leak criterion c2, owing to a rise in the atmospheric pressure. In the system of the embodiment, during the downhill driving, a negative correction value (Pa1−Pa2) corresponding to the rise in atmospheric pressure is added to the second pressure differential DP4 which may become larger by the rise in atmospheric pressure. In this manner, the system of the embodiment effectively properly compensates for the second pressure differential DP4 (that is, the calculated leak area AL2) even in the presence of changes in atmospheric pressure (or changes in altitude), such as an environmental change from flat-road driving to uphill driving or downhill driving. Irrespective of the fact that a popular relative-pressure sensor (a gage pressure sensor) is used for sampling the first and second pressure differentials DP3 and DP4, the system of the embodiment can eliminate the influence of changes in atmospheric pressure upon the leak diagnosis.

Figure 6:
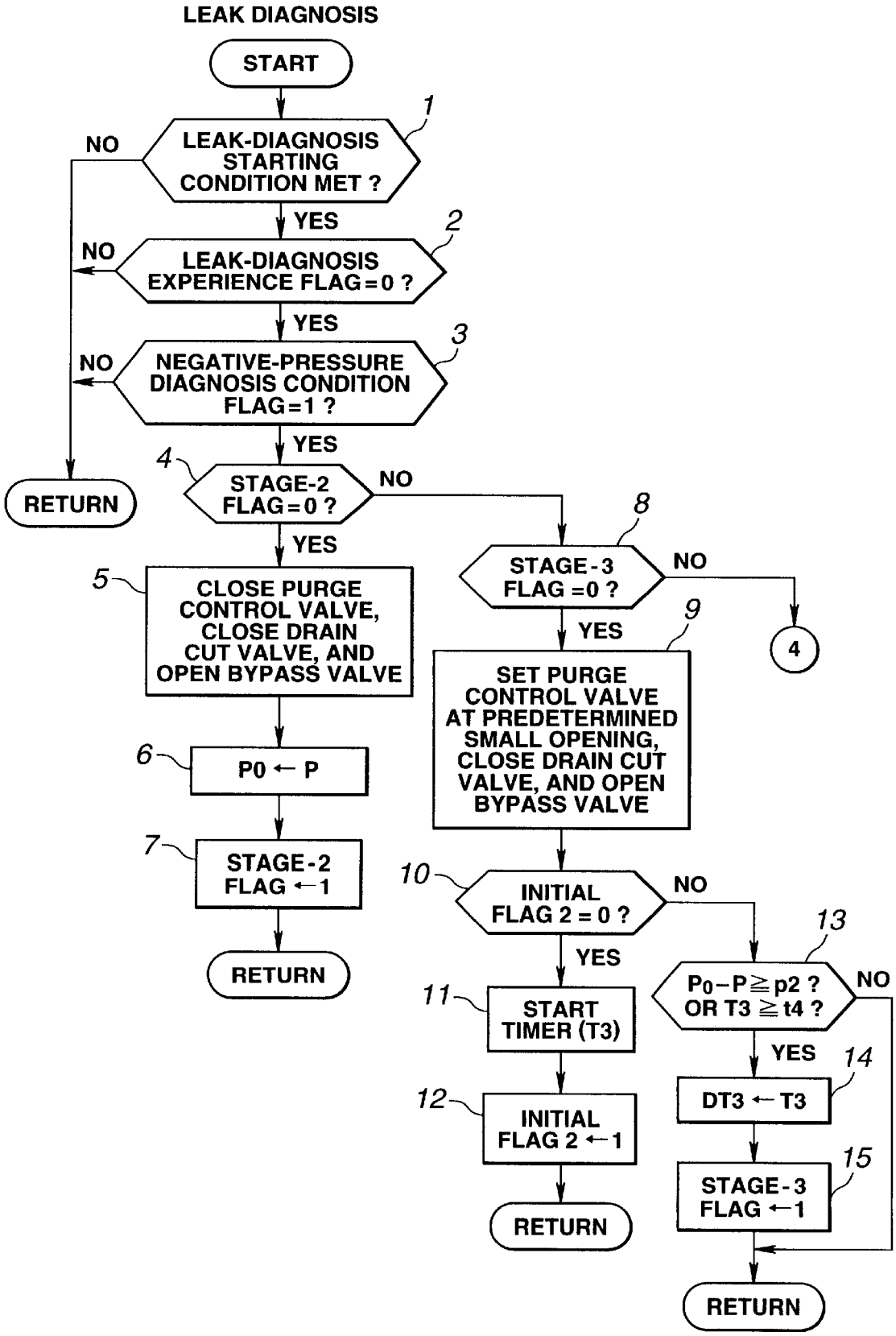
FIGS. 6 and 7 show a flowchart illustrating a series of leak-diagnosis procedures executed by the system of the embodiment.
Figure 7:
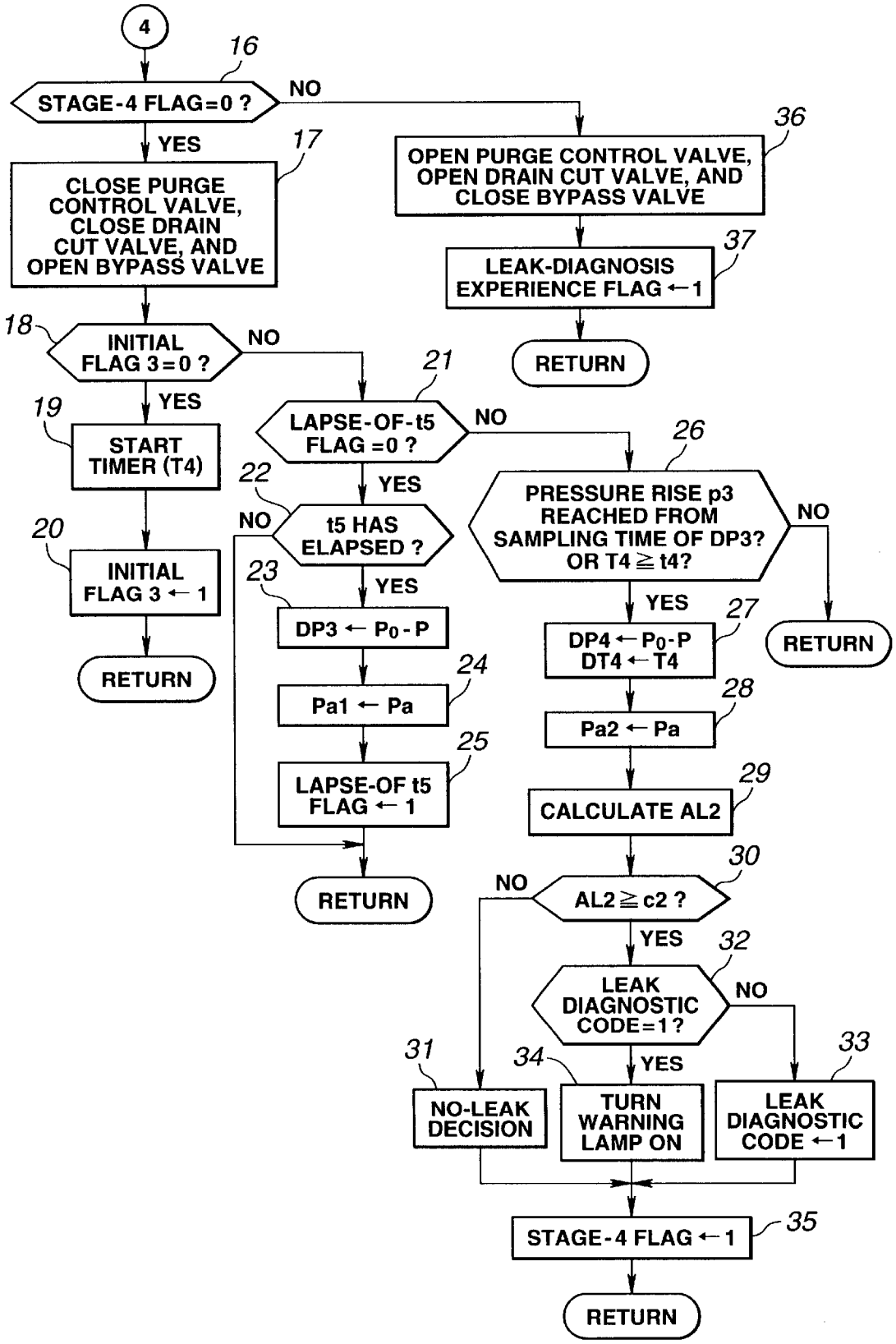

The leak diagnosis routine executed by the electronic control module (ECM) 21 is hereinafter described in detail by reference to the flow charts shown in FIGS. 6 and 7. The leak diagnosis routine of FIGS. 6 and 7 is cyclically executed as time-triggered interrupt routines to be triggered every predetermined time intervals such as 10 milliseconds.

Figure 5:
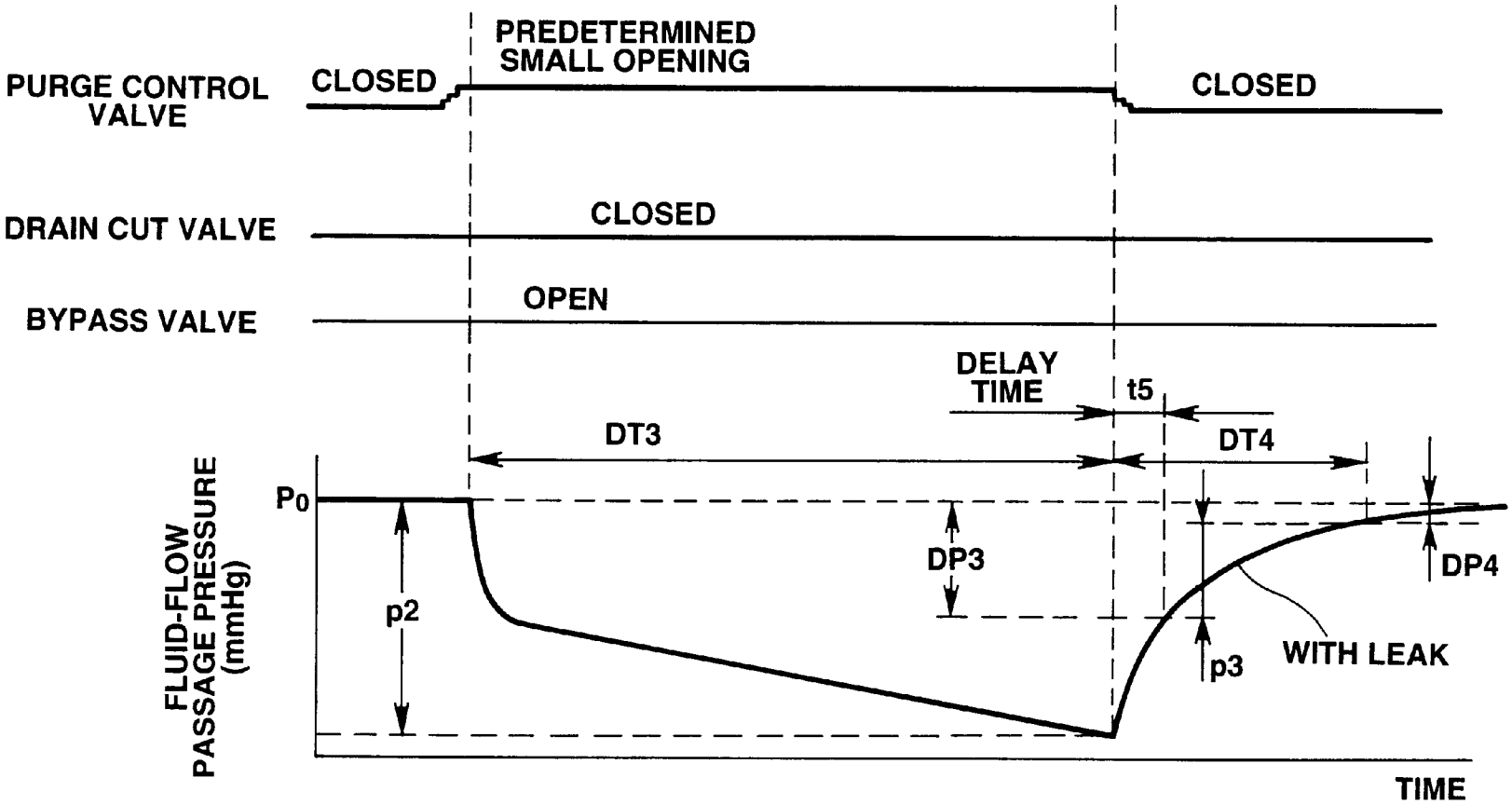
FIG. 5 shows a fluid-flow passage pressure-change indicative waveform obtained in the presence of leak in the evaporative emission control system during the leak diagnosing mode.

In step 1, a test is made to determine whether a predetermined leak-diagnosis starting condition (for example, the relative-pressure sensor normally operates, and there is no failure in both the drain cut valve 12 and the bypass valve 14) is met. When the answer to step 1 is in the affirmative (YES), that is, when the predetermined leak-diagnosis starting condition is satisfied, step 2 occurs. When the answer to step 1 is negative (NO), the procedure returns to step 1, while terminating the current time-triggered interrupt routine. In step 2, a test is made to determine whether a leak-diagnosis experience flag is reset. If the leak diagnosis is not executed once during the current engine running after the current routine is time-triggered, the leak-diagnosis experience flag is reset to "0". In this manner, when the answer to step 2 is affirmative (YES), step 3 occurs. In step 3, a test is made to determine whether the predetermined negative-pressure diagnosis condition (at least one of a first condition where the pressure of air induced into the induction system is below the predetermined pressure threshold (−300 mmHg) and a second condition where the driver's selected gear position is a fourth gear position or a fifth gear position in automotive vehicles with manual transmission) is met. Actually, the ECM 21 determines on the basis of a negative-pressure diagnosis condition flag, as to whether the negative-pressure diagnosis condition is satisfied or unsatisfied. When the answer to step 3 is negative (NO), the current routine terminates. To the contrary, when the answer to step 3 is affirmative (YES), that is, the negative-pressure diagnosis condition flag is set at "1", the procedure flows to step 4. In the embodiment, a predetermined leak-diagnosis permission condition includes the previously-noted predetermined leak-diagnosis starting condition, the leak-diagnosis experience flag =0, and the predetermined negative-pressure diagnosis condition flag =1. All of flags (containing the above-mentioned leak diagnosis experience flag and the negative-pressure diagnosis condition flag) indicated in the flow chart of FIGS. 6 and 7, and a count value of a timer T3 and a count value of a timer T4 are initialized or reset or cleared, when the engine/vehicle is started. The following steps 4 through 7 correspond to the first stage (STAGE 1) shown in FIG. 4. As previously explained by reference to the timing chart shown in FIG. 4, a series of leak diagnosis procedures are divided into four stages. In step 4, a test is made to determine a STAGE-2 flag is reset to "0". When the leak diagnosis is not yet executed or during the early stages of the leak diagnosis, the STAGE-2 flag is reset and a STAGE-3 flag and a STAGE-4 flag, both of which will be fully described later, are also reset. That is, when the answer to step 4 is affirmative (YES), step 5 occurs. In step 5, the ECM generates control signals so that the purge control valve 11 and the drain cut valve 12 are both closed and the bypass valve 14 is opened. If the canister purging operation is made, the purging is thus stopped by way of the purge control valve temporarily closed. The leak diagnosis routine then proceeds to step 6. In step 6, the internal pressure in the predetermined pressure-change monitoring fluid-flow passage section is sensed or sampled as a fluid-flow passage pressure P just before introducing negative pressure (engine vacuum pressure) by means of the relative-pressure sensor 13, and then a value of the fluid-flow passage pressure P sampled just before the introduction of negative pressure is stored in a predetermined memory address of the memory as an initial pressure $P_0$. Thereafter, in step 7, the STAGE-2 flag is set at "1", and thus one cycle of the routine terminates. In the next routine (referred to as a "second-time-triggered routine"), the leak diagnosis program proceeds from step 4 to step 8, since the STAGE-2 flag has already been set at "1" through the previous routine (referred to as a "first-time-triggered routine") executed one cycle before. In step 8, a test is made to determine whether the STAGE-3 flag is reset to "0". When the STAGE-3 is reset, the routine proceeds to step 9. In step 9, the ECM 21 generates control signals to control the opening of the purge control valve 11 to the predetermined small opening, while maintaining the closed state of the drain cut valve 12 and the open state of the bypass valve 14. Then, step 10 occurs. In step 10, a test is made to determine whether an initial flag 2, which is needed to activate or start the timer T3, is reset to "0". When the leak diagnosis is not yet executed or during the early stages of the leak diagnosis, the initial flag 2 is reset to "0", and an initial flag 3, which will be fully described later, is also reset. Thus, the second-time-triggered routine flows from step 10 to step 11. In step 11, the timer T3 starts to measure an elapsed time from a time when the purge control valve 11 is shifted to its predetermined small opening (see the beginning of the second earliest stage (STAGE 2) of FIG. 4) so that the engine vacuum (the negative pressure) is admitted to the predetermined pressure-change monitoring fluid-flow passage section, and thus the fluid-flow passage pressure falls. Thereafter, in step 12, the initial flag 2 is set at "1", and the second-time-triggered routine terminates. Then, a new time-triggered routine (referred to as a "third-time-triggered routine") proceeds from step 1 through steps 2, 3, 4, 8 and 9 via step 10 to step 13, since the initial flag 2 has already been set at "1" through the second-time-triggered routine. In step 13, the initial pressure $P_0$ stored in its predetermined memory address is extracted, and the pressure differential ($P_0$−P) between the initial pressure value $P_0$ and the latest up-to-date fluid-flow passage pressure data P is arithmetically calculated. Additionally, in step 13, the pressure differential ($P_0$−P) is compared with the predetermined value p2 (for example, several 10 mmHg). In case that the pressure differential ($P_0$−P) reaches the predetermined value p2 without the elapsed time (measured by the timer T3) above the predetermined time period t4 (for example, several minutes), that is, in case of ($P_0$−P)≧p2, the third-time-triggered routine proceeds from step 13 to step 14. Also, in case that the predetermined time period t4 has elapsed from the start of entry of the engine vacuum without reaching the predetermined value p2, that is, in case of T3≧t4, the third-time-triggered routine proceeds from step 13 to step 14. In step 14, the elapsed time measured by the timer T3 is stored as the first-sampled time interval DT3 (a variable) in a predetermined memory address, at a time when the condition of ($P_0$−P)≧p2 is met or the condition of T3≧t4 is met. Thereafter, in step 15, the STAGE-3 flag is set at "1", and thus the leak diagnosis routine is shifted from the second earliest stage (STAGE 2) to the third stage (STAGE 3). In step 13, when the conditions defined by inequalities (($P_0$−P)≧p2 and T3≧t4) are both unsatisfied, the current routine jumps from step 13 and returns to step 1. A new time-triggered routine then proceeds from step 1 through steps 2, 3, and 4 via step 8 to step 16, since the STAGE-3 flag has already been set at "1" through the third-time-triggered routine. In step 16, a test is made to determine whether the STAGE-4 flag is reset to "0". At this stage, since the STAGE-4 flag remains reset, the routine proceeds from step 16 to step 17. In step 17, the purge control valve 11 is closed again, the drain cut valve 12 remains closed, and also the bypass valve 14 remains opened. As a result, the predetermined pressure-change monitoring fluid-flow passage section is closed again at the beginning of the third stage (STAGE 3). Then, the routine flows to step 18. In step 18, a test is made to determine whether the initial flag 3, which is needed to activate or start the timer T4, is reset to "0". At the beginning of the third stage, the initial flag 3 is still reset, and thus the routine proceeds to step 19. In step 19, the timer T4 starts to measure an elapsed time from a time when the purge control valve is shifted again to its closed position at the end of the second earliest stage (STAGE 2). In step 20, the initial flag 3 is set at "1", and then a new time-triggered routine initiates. The new routine proceeds from step 1, through steps 2, 3, 4, 8, 16 and 17 via step 18 to step 21. In step 21, on the basis of a lapse-of-t5 flag, a check is made to compare the elapsed time measured by the timer T4 with the predetermined time period t5. Just after the start of the timer T4, the lapse-of-t5 flag is reset to "0", and thus step 22 occurs. In step 22, a test is made to determine if the elapsed time measured by the timer T4 reaches the predetermined time period t5 (e.g., several seconds). When the answer to step 22 is affirmative (YES), that is, when the elapsed time measured by the timer T4 reaches the predetermined time period t5, step 23 occurs. The routine proceeds from step 22 through steps 23 and 24 to step 25. In step 23, the pressure differential ($P_0$−P) between the initial pressure $P_0$ and the latest up-to-date fluid-flow passage pressure P sensed or sampled with the lapse of the predetermined time period t5 is arithmetically calculated, and the calculated pressure differential ($P_0$−P) is stored as the first pressure differential DP3 (a variable) in a predetermined memory address. In step 24, the atmospheric pressure Pa is sampled or sensed by means of the atmospheric-pressure sensor 22 at the same sampling time as the first pressure differential DP3. The atmospheric pressure Pa sampled is stored as the first atmospheric pressure value Pa1 (a variable) in a predetermined memory address. In step 25, the lapse-of-t5 flag is set at "1". When the answer to step 22 is negative (NO), the flow from step 18 via step 21 to step 22 is repeated, until the elapsed time measured by the timer T4 reaches the predetermined time period t5. After the lapse-of-t5 flag has been set through step 25, a new time-triggered routine begins. The new routine proceeds from step 1 through steps 2, 3, 4, 8, 16, 17 and 18 via step 21 to step 26. In step 26, a test is made to determine whether a predetermined pressure rise p3 (e.g., several mmHg) is reached from the sampling time of the first pressure differential DP3, in the presence of the predetermined pressure rise p3 from the sampling time of the first pressure differential DP3 without the elapsed time (measured by the timer T4) above the predetermined time period t4 (e.g., several minutes). Also, in case that the predetermined time period t4 has elapsed from the sampling time of the first pressure differential DP3 without reaching the predetermined pressure rise p3, that is, in case of T4≧t4, step 27 occurs. In step 27, the elapsed time measured by the timer T4 is stored as the second-sampled time interval DT4 (a variable) in a predetermined memory address, at a time when the condition that the predetermined pressure rise p3 is reached from the sampling time of the first pressure differential DP3 is met or the condition of T4≧t4 is met. At the same time of sampling of the second-sampled timer interval DT4, the latest up-to-date pressure differential data ($P_0$−P) is stored as the second pressure differential DP4 (a variable). Then, the routine flows from step 27 through steps 28 and 29 to step 30. In step 28, the atmospheric pressure Pa is sampled at the same sampling time as the second pressure differential DP4. The atmospheric pressure Pa sampled is stored as the second atmospheric pressure value Pa2 (a variable) in a predetermined memory address. In step 29, the leak area AL2 is arithmetically calculated from the previously-discussed expression (3) and (4), considering the atmospheric-pressure change (Pa1−Pa2) between the first and second atmospheric pressure values Pa1 and Pa2. In this manner, during the leak diagnosis mode, sampling operations for the six parameters DT3, DT4, DP3, DP4, Pa1, and Pa2 are completed. Thereafter, in step 30, a test is made to determine whether the calculated leak area AL2 is above the predetermined leak criterion c2. When the answer to step 30 is negative (NO), that is, when the condition of AL2<c2 is satisfied, the routine proceeds to step 31 in which the processor of the ECM 21 determines that there is no leak in the evaporative emission control system (more exactly, in the predetermined pressure-change monitoring fluid-flow passage section). Conversely, when the answer to step 30 is affirmative (YES), that is, when the condition of AL2≧c2 is met, the routine proceeds to step 32. In step 32, a test is made to determine whether the leak diagnostic code, stored in its predetermined memory address of the memory (backup RAM), is set at "1" or reset to "0". When the leak diagnostic code is reset to "0", step 33 occurs. The diagnostic code "0" (that is, the flow from step 30 via step 32 to step 33) means that, for the first time in the leak diagnosis, the ECM decides that there is a leak above the predetermined leak criterion. In step 33, the leak diagnostic code is set at the code number "1" representative of the presence of leak, and then the leak indicating code is memorized in the memory. Then, the routine flows to step 35. When the answer to step 32 is affirmative (YES), that is, when the leak diagnostic code has been set at "1", the routine flows to step 34. In step 34, a warning lamp built-in the instrument panel in the vehicle compartment comes on, based on the comparison result that the calculated leak area AL2 exceeds the predetermined leak criterion c2. Thereafter, in step 35, the STAGE-4 flag is set at "1", and thus the leak diagnosis procedure shifts from the third stage (STAGE 3) to the last stage (STAGE 4). Then, a new time-triggered routine begins. The new routine proceeds from step 1 through steps 2, 3, 4, 8, and 16 via step 36 to step 37. During the previously-discussed leak diagnosis mode, the canister purging is temporarily stopped. After shifting to the last stage (STAGE 4) through step 35, at step 36 the purge control valve 11 and the drain cut valve 12 are opened, whereas the bypass valve 14 is closed, so as to restart the canister purging. To prevent the leak diagnosis from being repeated until the engine is stopped, at step 37 the leak-diagnosis experience flag is set at "1", and thus the current routine terminates. With the leak-diagnosis experience flag set at "1", the next routine cannot proceed from step 2 to step 3. As a consequence, the leak diagnosis can be performed once in a cycle from the engine starting and running to engine off. As can be appreciated from comparison between the two different characteristic curves representative of the change in the fluid-flow passage pressure P in the presence of leak (see FIG. 4) and in the absence of leak (see FIG. 5), the pressure-fall in the fluid-flow passage pressure P, obtained in case of no leak (see FIG. 4), is faster than that in presence of leak (see FIG. 5). In other words, in the second earliest stage (STAGE 2), the first-sampled time interval DT3 shown in FIG. 5 tends to become longer than that shown in FIG. 4. Additionally, as seen in FIG. 5, a time rate of pressure-rise of the fluid-flow passage pressure P tends to become steep as compared to the pressure rise shown in FIG. 4. In other words, in the third stage (STAGE 3), the second-sampled time interval DT4 shown in FIG. 4 tends to become longer than that shown in FIG. 5.

Figure 10:
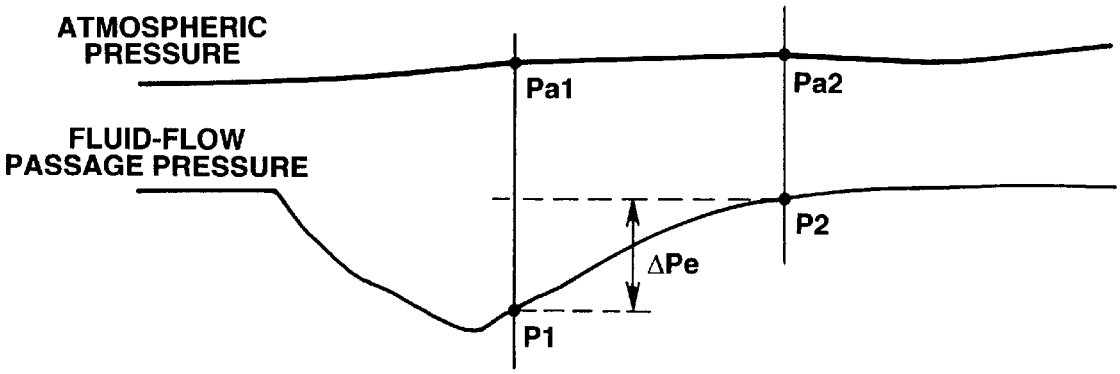
FIG. 10 is a waveform illustrating changes in atmospheric pressure during a modified leak diagnosing mode at which a pressure differential ($\Delta Pe=P1-P2$) is determined as the difference between the first-sampled and secondly-sampled pressure values (P1 and P2) in the predetermined pressure-change monitoring fluid-flow passage section, and the presence or absence of leak is determined by comparing the pressure differential ($\Delta Pe$) with a predetermined threshold value.
Figure 11:
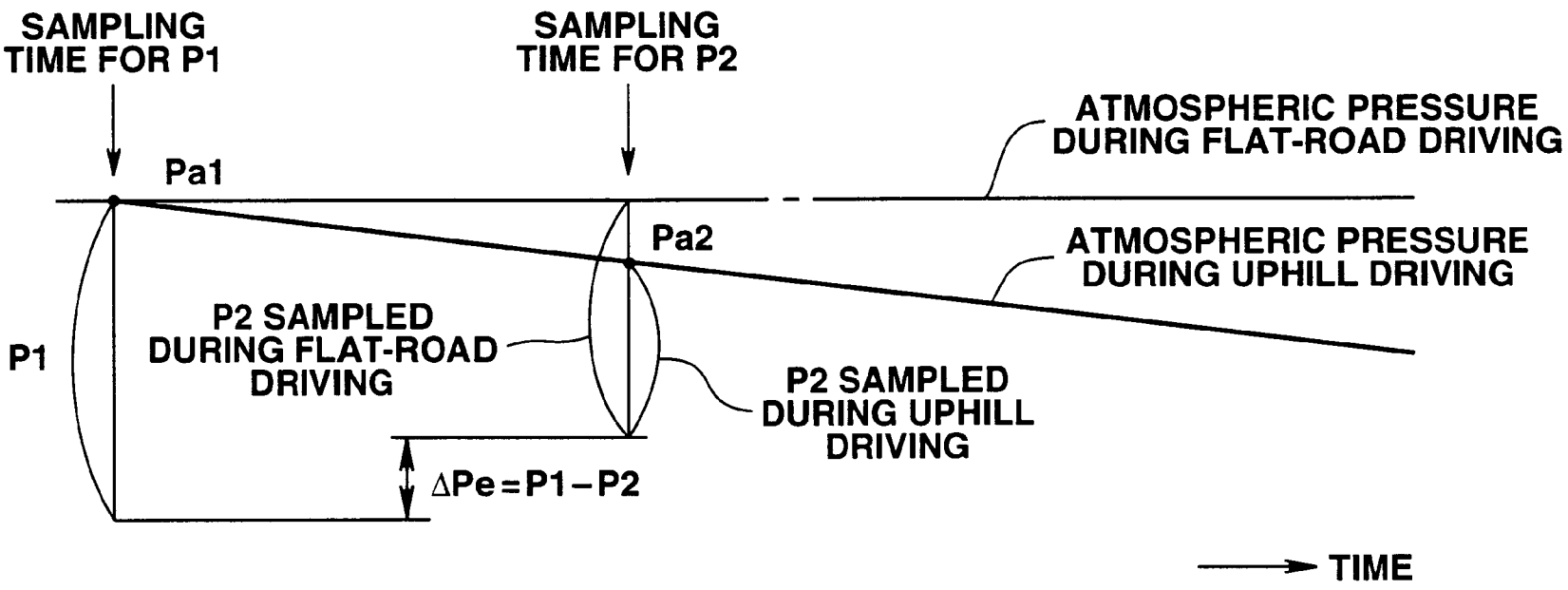
FIG. 11 is an explanatory drawing for an error included in the pressure differential ($\Delta Pe$) owing to the change in atmospheric pressure.

The leak diagnostic system of the previously-noted embodiment is exemplified as a leak diagnostic apparatus based on comparison between the calculated leak area AL2 and its predetermined leak criterion c2. It will be understood that the invention is not limited to the embodiment previously discussed. The basic concept of the invention can be applied to another leak diagnostic system utilizing a change in internal pressure in the predetermined pressure-change monitoring fluid-flow passage section. Concretely, as may appreciated from FIGS. 10 and 11, a pressure P1 in the predetermined pressure-change monitoring fluid-flow passage section is first sensed or sampled by the popular relative-pressure sensor 13 with the lapse of a predetermined time period during which gas fluid-flow stops and thus there is no pressure loss after completion of the decompressing operation. Second, a pressure P2 in the predetermined pressure-change monitoring fluid-flow passage section is sensed or sampled again as soon as a predetermined period of time has elapsed from the sampling time of the pressure P1. Thereafter, a change in internal pressure in the predetermined pressure-change monitoring fluid-flow passage section, that is, the pressure differential ΔPe (=P1−P2) is computed as subtraction (P1−P2) of P2 from P1. According to the basic concept of the invention, the atmospheric pressure Pa is sampled as a first atmospheric pressure value Pa1 at the sampling time of the first-sampled internal pressure P1, and thereafter the atmospheric pressure (Pa) is sampled again as a second atmospheric pressure value Pa2 at the sampling time of the second-sampled pressure P2. The, the atmospheric-pressure change (Pa1−Pa2) between the first and second atmospheric pressure values Pa1 and Pa2 is calculated. The compensation for the pressure differential ΔPe is performed by subtracting the atmospheric-pressure change (Pa1−Pa2) from the pressure differential ΔPe. As previously discussed in reference to FIG. 11, the second-sampled fluid-flow passage pressure P2 sampled during uphill driving must be fundamentally identical to that sampled during flat-road driving. Owing to the use of the popular relative-pressure sensor 13, the second-sampled fluid-flow passage pressure P2 is affected by the change (ΔPa) in atmospheric pressure Pa, and as a result a value of the second-sampled fluid-flow passage pressure P2 sampled during the uphill driving (with changes in atmospheric pressure or altitude) tends to be less than a value of the second-sampled fluid-flow passage pressure P2 sampled during the flat-road driving (without any change in atmospheric pressure or altitude). In the presence of the fall in atmospheric pressure during the leak diagnosis mode, hitherto, the second-sampled fluid-flow passage pressure P2 contains the error corresponding to the atmospheric-pressure change ΔPa (=Pa1−Pa2). In the presence of the fall in atmospheric pressure (Pa) during the leak diagnosis mode, in the conventional system, the pressure differential ΔPe (=P1−P2) may be arithmetically calculated apparently as a pressure differential greater than the predetermined threshold value. On the other hand, in the arithmetic calculation for the pressure differential ΔPe, executed by the system of the invention, during the uphill driving, a positive correction value (Pa1−Pa2) corresponding to the fall in atmospheric pressure (Pa) is subtracted from the pressure differential ΔPe which may become larger by the fall in atmospheric pressure. Conversely, if the leak diagnosis is executed during downhill driving, the pressure differential ΔPe may be calculated apparently as a pressure differential less than the predetermined threshold value, owing to a rise in the atmospheric pressure. In the system of the embodiment, during the downhill driving, a negative correction value (Pa1−Pa2) corresponding to the rise in atmospheric pressure is subtracted from the pressure differential ΔPe which may become smaller by the rise in atmospheric pressure. In this manner, the system of the embodiment effectively properly compensates for the pressure differential ΔPe even in the presence of changes in atmospheric pressure (or changes in altitude), such as an environmental change from flat-road driving to uphill driving or downhill driving. Irrespective of the fact that a popular relative-pressure sensor (a gage pressure sensor) is used for sampling the first and second fluid-flow passage pressures P1 and P2, the system of the invention can eliminate the influence of changes in atmospheric pressure upon the leak diagnosis.

The entire contents of Japanese Patent Application No. P10-235334 (filed Aug. 21, 1998) is incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A leak diagnostic system of an evaporative emission control system for an internal combustion engine having a canister with an air vent, comprising:

a first fluid-flow passage introducing fuel vapors emitted from a fuel tank into the canister;

a second fluid-flow passage through which the canister is connected to an intake pipe of an induction system;

a purge control valve opening and closing said second fluid-flow passage;

a drain cut-off valve opening and closing the air vent of the canister;

a relative-pressure sensor sensing a pressure in a predetermined fluid-flow passage ranging from the fuel tank via the canister to said purge control valve, relative to atmospheric pressure;

an atmospheric-pressure sensor sensing the atmospheric pressure; and a control module configured to be connected to at least said purge control valve, said drain cut-off valve, said relative-pressure sensor, and said atmospheric-pressure sensor;

said control module comprising:

a leak-diagnosis permission condition decision section determining whether a predetermined leak-diagnosis permission condition is met;

a decompression section reducing the pressure in the predetermined fluid-flow passage, while adjusting both an opening of said drain cut-off valve and an opening of said purge control valve, only when the predetermined leak-diagnosis permission condition is met;

a first sampling section sampling the pressure in the predetermined fluid-flow passage as a first fluid-flow passage pressure at a first sampling time when a predetermined decompressing operation is completed by said decompression section, and sampling the pressure in the predetermined fluid-flow passage as a second fluid-flow passage pressure at a second sampling time when a predetermined time interval has been elapsed from the first sampling time;

a first arithmetic-calculation section calculating a pressure differential between the first and second fluid-flow passage pressures;

a second sampling section sampling the atmospheric pressure sensed by said atmospheric-pressure sensor as a first atmospheric pressure at the first sampling time and sampling the atmospheric pressure sensed by said atmospheric-pressure sensor as a second atmospheric pressure at the second sampling time;

a second arithmetic-calculation section calculating an atmospheric-pressure change between the first and second atmospheric pressures;

a compensation section compensating for the pressure differential calculated by said first arithmetic-calculation section by the atmospheric-pressure change calculated by said second arithmetic-calculation section to produce a compensated pressure differential; and a leak-diagnosis section making a leak-diagnosis by comparing the compensated pressure differential with a predetermined threshold value.

2. A leak diagnostic system of an evaporative emission control system for an internal combustion engine having a canister with an air vent, comprising:

a first fluid-flow passage introducing fuel vapors emitted from a fuel tank into the canister;

a second fluid-flow passage through which the canister is connected to an intake pipe of an induction system;

a purge control valve opening and closing said second fluid-flow passage;

a drain cut-off valve opening and closing the air vent of the canister;

a relative-pressure sensor sensing a pressure in a predetermined fluid-flow passage ranging from the fuel tank via the canister to said purge control valve, relative to atmospheric pressure;

an atmospheric-pressure sensor sensing the atmospheric pressure; and a control module configured to be connected to at least said purge control valve, said drain cut-off valve, said relative-pressure sensor, and said atmospheric-pressure sensor;

said control module comprising:

a leak-diagnosis permission condition decision section determining whether a predetermined leak-diagnosis permission condition is met;

a decompression section reducing the pressure in the predetermined fluid-flow passage, while adjusting both an opening of said drain cut-off valve and an opening of said purge control valve, only when the predetermined leak-diagnosis permission condition is met;

a first sampling section sampling the pressure in the predetermined fluid-flow passage as an initial pressure just before a predetermined decompressing operation is started by said decompression section, the pressure in the predetermined fluid-flow passage as a first fluid-flow passage pressure at a first sampling time when the predetermined decompressing operation is completed, and sampling the pressure in the predetermined fluid-flow passage as a second fluid-flow passage pressure at a second sampling time when a predetermined time interval has been elapsed from the first sampling time;

a first arithmetic-calculation section calculating a first pressure differential between the initial pressure and the first fluid-flow passage pressure, and calculating a second pressure differential between the initial pressure and the second fluid-flow passage pressure;

a second sampling section sampling the atmospheric pressure sensed by said atmospheric-pressure sensor as a first atmospheric pressure at the first sampling time and sampling the atmospheric pressure sensed by said atmospheric-pressure sensor as a second atmospheric pressure at the second sampling time;

a second arithmetic-calculation section calculating an atmospheric-pressure change between the first and second atmospheric pressures;

a compensation section compensating for the second pressure differential calculated by said first arithmetic-calculation section by the atmospheric-pressure change calculated by said second arithmetic-calculation section to produce a compensated pressure differential;

a third arithmetic-calculation section calculating a leak area on the basis of the first pressure differential and the compensated pressure differential; and a leak-diagnosis section making a leak-diagnosis by comparing the leak area calculated by said third arithmetic-calculation section with a predetermined leak criterion.

3. The leak diagnostic system as claimed in claim 2, wherein said third arithmetic-calculation section calculates the leak area AL2 from the following expression:

$$AL2=K\times C\times(DT3/DT4)\times Ac\times\{(DP3)^{1/2}-(DP4+Pa1-Pa\ 2)^{1/2}\}/DP3$$

where K is a first correction factor, C is a second correction factor needed for matching among units, Ac is an orifice opening of said purge control valve whose opening is reduced to a predetermined small opening during the decompressing operation of said decompression section, DT3 is a first time interval from the sampling time of the initial pressure to the first sampling time of the first fluid-flow passage pressure, DT4 is a second time interval obtained by adding a predetermined delay time (t5) needed to stop gas fluid flow in the predetermined fluid-flow passage to the predetermined time interval (DT4–t5) elapsed from the first sampling time, DP3 is the first pressure differential, and DP4 is the second pressure differential, and (Pa1–Pa2) is the atmospheric-pressure change.

4. In an internal combustion engine equipped with an evaporative emission control system having at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, a leak diagnostic system of the evaporative emission control system, comprising:

a relative-pressure sensing means for sensing a pressure in a predetermined fluid-flow passage ranging from the fuel tank via the canister to the purge control valve, relative to atmospheric pressure;

an atmospheric-pressure sensing means for sensing the atmospheric pressure; and control means configured to be connected to at least the purge control valve, the drain cut-off valve, said relative-pressure sensing means, and said atmospheric-pressure sensing means;

said control means comprising:

a leak-diagnosis permission condition decision means for determining whether a predetermined leak-diagnosis permission condition is met;

a decompression means for reducing the pressure in the predetermined fluid-flow passage, while adjusting both an opening of the drain cut-off valve and an opening of the purge control valve, only when the predetermined leak-diagnosis permission condition is met;

a first sampling means for sampling the pressure in the predetermined fluid-flow passage as a first fluid-flow passage pressure at a first sampling time when a predetermined decompressing operation is completed by said decompression means, and sampling the pressure in the predetermined fluid-flow passage as a second fluid-flow passage pressure at a second sampling time when a predetermined time interval has been elapsed from the first sampling time;

a first arithmetic-calculation means for calculating a pressure differential between the first and second fluid-flow passage pressures;

a second sampling means for sampling the atmospheric pressure sensed by said atmospheric-pressure sensing means as a first atmospheric pressure at the first sampling time and sampling the atmospheric pressure sensed by said atmospheric-pressure sensing means as a second atmospheric pressure at the second sampling time;

a second arithmetic-calculation means for calculating an atmospheric-pressure change between the first and second atmospheric pressures;

a compensation means for compensating for the pressure differential calculated by said first arithmetic-calculation means by the atmospheric-pressure change calculated by said second arithmetic-calculation means to produce a compensated pressure differential; and a leak-diagnosis means for making a leak-diagnosis by comparing the compensated pressure differential with a predetermined threshold value.

5. In an internal combustion engine equipped with an evaporative emission control system having at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, a leak diagnostic system of the evaporative emission control system, comprising:

a relative-pressure sensing means for sensing a pressure in a predetermined fluid-flow passage ranging from the fuel tank via the canister to the purge control valve, relative to atmospheric pressure;

an atmospheric-pressure sensing means for sensing the atmospheric pressure; and control means configured to be connected to at least the purge control valve, the drain cut-off valve, said relative-pressure sensing means, and said atmospheric-pressure sensing means;

said control means comprising:

a leak-diagnosis permission condition decision means for determining whether a predetermined leak-diagnosis permission condition is met;

a decompression means for reducing the pressure in the predetermined fluid-flow passage, while adjusting both an opening of the drain cut-off valve and an opening of the purge control valve, only when the predetermined leak-diagnosis permission condition is met;

a first sampling means for sampling the pressure in the predetermined fluid-flow passage as an initial pressure just before a predetermined decompressing operation is started by said decompression means, the pressure in the predetermined fluid-flow passage as a first fluid-flow passage pressure at a first sampling time when the predetermined decompressing operation is completed, and sampling the pressure in the predetermined fluid-flow passage as a second fluid-flow passage pressure at a second sampling time when a predetermined time interval has been elapsed from the first sampling time;

a first arithmetic-calculation means for calculating a first pressure differential between the initial pressure and the first fluid-flow passage pressure, and calculating a second pressure differential between the initial pressure and the second fluid-flow passage pressure;

a second sampling means for sampling the atmospheric pressure sensed by said atmospheric-pressure sensing means as a first atmospheric pressure at the first sampling time and sampling the atmospheric pressure sensed by said atmospheric-pressure sensing means as a second atmospheric pressure at the second sampling time;

a second arithmetic-calculation means for calculating an atmospheric-pressure change between the first and second atmospheric pressures;

a compensation means for compensating for the second pressure differential calculated by said first arithmetic-calculation means by the atmospheric-pressure change calculated by said second arithmetic-calculation means to produce a compensated pressure differential;

a third arithmetic-calculation means for calculating a leak area on the basis of the first pressure differential and the compensated pressure differential; and a leak-diagnosis means for making a leak-diagnosis by comparing the leak area calculated by said third arithmetic-calculation means with a predetermined leak criterion.

6. A method for making a leak diagnosis on an evaporative emission control system for an internal combustion engine, wherein the evaporative emission control system includes at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, the method comprising:

sensing a pressure in a predetermined fluid-flow passage ranging from the fuel tank via the canister to the purge control valve, relative to atmospheric pressure, sensing the atmospheric pressure, determining whether a predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, sampling the pressure in the predetermined fluid-flow passage as a first fluid-flow passage pressure at a first sampling time when the pressure in the predetermined fluid-flow passage is reduced to a predetermined value, sampling the pressure in the predetermined fluid-flow passage as a second fluid-flow passage pressure at a second sampling time when a predetermined time interval has been elapsed from the first sampling time, calculating a pressure differential between the first and second fluid-flow passage pressures, sampling the atmospheric pressure as a first atmospheric pressure at the first sampling time, sampling the atmospheric pressure as a second atmospheric pressure at the second sampling time, calculating an atmospheric-pressure change between the first and second atmospheric pressures, compensating for the pressure differential between the first and second fluid-flow passage pressures by the atmospheric-pressure change to produce a compensated pressure differential, and making a leak-diagnosis by comparing the compensated pressure differential with a predetermined threshold value.

7. A method for making a leak diagnosis on an evaporative emission control system for an internal combustion engine, wherein the evaporative emission control system includes at least a canister having an air vent and temporarily adsorbing fuel vapors emitted from a fuel tank, a fuel-tank vapor vent line introducing the fuel vapors into the canister, a purge line through which the canister is connected to an intake pipe of an induction system, a purge control valve disposed in the purge line, and a drain cut-off valve opening and closing the air vent of the canister, the method comprising:

sensing a pressure in a predetermined fluid-flow passage ranging from the fuel tank via the canister to the purge control valve, relative to atmospheric pressure, sensing the atmospheric pressure, determining whether a predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, reducing the pressure in the predetermined fluid-flow passage, while adjusting both an opening of the drain cut-off valve and an opening of the purge control valve, only when the predetermined leak-diagnosis permission condition is met, sampling the pressure in the predetermined fluid-flow passage as an initial pressure just before starting to reduce the pressure in the predetermined fluid-flow passage, sampling the pressure in the predetermined fluid-flow passage as a first fluid-flow passage pressure at a first sampling time when the pressure in the predetermined fluid-flow passage is reduced to a predetermined value, sampling the pressure in the predetermined fluid-flow passage as a second fluid-flow passage pressure at a second sampling time when a predetermined time interval has been elapsed from the first sampling time, calculating a first pressure differential between the initial pressure and the first fluid-flow passage pressure, calculating a second pressure differential between the initial pressure and the second fluid-flow passage pressure, sampling the atmospheric pressure as a first atmospheric pressure at the first sampling time, sampling the atmospheric pressure as a second atmospheric pressure at the second sampling time, calculating an atmospheric-pressure change between the first and second atmospheric pressures, compensating for the second pressure differential by the atmospheric-pressure change to produce a compensated pressure differential, calculating a leak area on the basis of the first pressure differential and the compensated pressure differential, and making a leak-diagnosis by comparing the leak area with a predetermined leak criterion.

8. The method as claimed in claim 7, wherein the leak area AL2 is arithmetically calculated from the following expression:

$$AL2=K\times C\times(DT3/DT4)\times Ac\times\{(DP3)^{1/2}-(DP4+Pa1-Pa\ 2)^{1/2}\}/DP3$$

where K is a first correction factor, C is a second correction factor needed for matching among units, Ac is an orifice opening of the purge control valve whose opening is reduced to a predetermined small opening during reduction in the pressure in the predetermined fluid-flow passage, DT3 is a first time interval from the sampling time of the initial pressure to the first sampling time of the first fluid-flow passage pressure, DT4 is a second time interval obtained by adding a predetermined delay time (t5) needed to stop gas fluid flow in the predetermined fluid-flow passage to the predetermined time interval (DT4−t5) elapsed from the first sampling time, DP3 is the first pressure differential, and DP4 is the second pressure differential, and (Pa1−Pa2) is the atmospheric-pressure change.

9. A leak diagnostic system as set forth in claim 1, wherein said atmospheric-pressure sensor continuously monitors atmospheric air pressure proximate the engine.

10. A leak diagnostic system as set forth in claim 2, wherein said atmospheric-pressure sensor continuously monitors atmospheric air pressure proximate the engine.

11. A leak diagnostic system as set forth in claim 4, wherein said atmospheric-pressure sensor continuously monitors atmospheric air pressure proximate the engine.

12. A leak diagnostic system as set forth in claim 5, wherein said atmospheric-pressure sensing means continuously monitors atmospheric air pressure proximate the engine.

13. A leak diagnostic system as set forth in claim 6, wherein said step of sensing atmospheric-pressure is continuously carried out proximate the engine.

14. A leak diagnostic system as set forth in claim 7, wherein said step of sensing atmospheric-pressure is continuously carried out proximate the engine.

* * * * *